US008251479B2

(12) United States Patent
Seki et al.

(10) Patent No.: US 8,251,479 B2
(45) Date of Patent: Aug. 28, 2012

(54) PRINTING APPARATUS

(75) Inventors: Satoshi Seki, Kawasaki (JP); Hiroshi Tajika, Yokohama (JP); Hitoshi Nishikori, Inagi (JP); Takeshi Yazawa, Yokohama (JP); Fumiko Yano, Tokyo (JP); Jun Yasutani, Kawasaki (JP); Atsushi Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 908 days.

(21) Appl. No.: 12/107,543

(22) Filed: Apr. 22, 2008

(65) Prior Publication Data

US 2008/0266348 A1 Oct. 30, 2008

(30) Foreign Application Priority Data

Apr. 27, 2007 (JP) ..... 2007-119915

(51) Int. Cl.
*B41J 29/38* (2006.01)

(52) U.S. Cl. ..... 347/16; 347/19

(58) Field of Classification Search ..... None
See application file for complete search history.

(56) References Cited

U.S. PATENT DOCUMENTS 6,960,036 B1 11/2005 Fujita et al.
7,354,129 B2 4/2008 Uchida
2006/0197785 A1* 9/2006 Uchida ..... 347/5
2007/0273720 A1 11/2007 Yasutani et al.
2007/0273899 A1 11/2007 Yazawa et al.
2008/0049061 A1* 2/2008 Iwakura ..... 347/16
2008/0252675 A1 10/2008 Yasutani et al.
2008/0252676 A1 10/2008 Yasutani et al.
2008/0252677 A1 10/2008 Tajika et al.
2009/0021551 A1 1/2009 Fletcher et al.

FOREIGN PATENT DOCUMENTS

JP 2005-313587 A 11/2005
JP 2006-240055 9/2006
JP 2006-240055 A 9/2006
JP 2006-272957 10/2006

OTHER PUBLICATIONS

Office Action issued in Japanese Patent Application No. 2007-119915, dated Sep. 30, 2011.

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

The present invention aims to obtain preferable correction values to correct the conveying error of a conveying roller in accordance with the size of a printing medium, even when the conveying error caused by the eccentricity of the roller varies from a point to another in the longitudinal direction of a roller, depending on the amount and the state of eccentricity of the roller. To achieve this object, correction values are acquired using the whole part of or only a part of plural test patterns formed in the longitudinal direction of the roller. The correction values thus acquired correspond to the respective zones where the test patterns are formed.

9 Claims, 39 Drawing Sheets

| | CORRECTION VALUE OF ECCENTRICITY ※ PARAMETER FOR ECCENTRICITY CORRECTION FUNCTION | | CORRECTION VALUE OF OUTER-DIAMETER ※ BEFORE CONVERSION OF CORRECTION VALUE OF OUTER-DIAMETER |
|---|---|---|---|
| | AMPLITUDE | PHASE | |
| CORRECTION OF ECCENTRICITY ⇒ CORRECTION OF OUTER-DIAMETER | 0.0003 | 13 | 9.31 [μm] |
| CORRECTION OF OUTER-DIAMETER ⇒ CORRECTION OF ECCENTRICITY | 0.0003 | 13 | 8.74 [μm] |

※ CORRECTION VALUE OF OUTER-DIAMETER THEORETICAL VALUE : 8.54μm

FIG.25

PRINTING APPARATUS

BACKGROUND OF THE INVENTION

1. Field of the Invention

The present invention relates to a printing apparatus. Specifically, the invention relates to a technique to acquire a correction value to correct an error in conveying a printing medium used in an inkjet printing apparatus.

2. Description of the Related Art

An inkjet printing apparatus has a print head that has a fine-nozzle array, and ink is ejected from each nozzle in accordance with printing data. The ejected ink forms dots on the printing medium to form an image. Accordingly, to form a high-quality image, it is important that the dots should be formed on the printing medium at intended positions. The displacement of the dot-formation position has to be avoided as much as possible. Some of the various causes of such displacement deviation are: difference in shape amongst the nozzles of the print head; noise factors, such as the vibrations of the apparatus that occur while the printing is being carried out; and the distance between the printing medium and the print head. The inventors of the present invention have discovered that one of the significant causes for such displacement deviation of the dot-formation position is the lack of accuracy in conveying the printing medium. One of the commonly used conveying unit for the printing medium is a roller (a conveying roller). Conveying the printing medium by a desired distance can be achieved by rotation of the conveying roller by a designated angle with the conveying roller being pressed onto the printing medium. Here, the accuracy in the conveying of the printing medium depends, to a significant extent, on the eccentricity of the conveying roller.

FIGS. 36, 37A and 37B, and 38 illustrate cross sectional shapes of various conveying rollers. The conveying roller of FIG. 36 has a perfectly-circular cross-sectional shape, and has its central axis aligned exactly with its rotational axis. The conveying roller of FIGS. 37A and 37B has a cross-sectional shape that is not a perfect circle. The conveying roller of FIG. 38 has its rotational axis offset from its central axis.

Assume such a case as shown in FIG. 36, or, to be more specific, a case where the cross-sectional shape of the conveying roller is a perfect circle and where the central axis of the conveying roller is aligned exactly with its rotational axis. In addition, further assume that the rotational angle to convey the printing medium is uniform. Then, every rotation of the conveying roller by an angle R constantly gives a particular length (L0) in the circumferential directions (length of arc). Accordingly, every position within the conveying roller always gives a uniform amount of conveying the printing medium that is conveyed while being in contact with the conveying roller.

Contrasting outcomes are obtained by a conveying roller with an ellipsoidal cross-sectional shape as ones shown in FIGS. 37A and 37B. Such a conveying roller gives different amount of conveying even when the conveying roller rotates by the same angle R. This difference in the amount of conveying depends on the rotational position of the conveying roller. To be more specific, for the rotational position shown in FIG. 37A, the printing medium is conveyed by an amount L1 while for another rotational position shown in FIG. 37B, the printing medium is conveyed by an amount L2. Here, the lengths L0, L1, and L2 has such a relationship as L1>L0>L2. That is to say, a periodical variation in amount of conveying the printing medium occurs, and the variation depends on the period of the conveying roller.

Alternatively, as in the case of FIG. 38, the offsetting of the rotational axis of the conveying roller from the central axis O that is intended to be the rotational axis may sometimes cause the amount of conveying the printing medium to vary periodically in response to the period of the conveying roller. To be more specific, assume cases where the rotational axis is offset from the central axis O and is positioned at either the point A or the point B shown in FIG. 38. In these cases, the same rotational angle $\alpha$ (produces different amounts of conveying. Such difference in conveying amount results in a periodical variation in the conveying of the printing medium. Here, the variation depends on the period of the conveying roller.

The eccentricity of the roller, which has been mentioned above, includes these above-described states. Specifically, included are a state where the roller has a cross-sectional shape that is not a perfect circle, and a state where the conveying roller has its rotational axis offset from its central axis. In the case of an ideal accuracy being achieved in conveying, the image should be printed in such a way as shown in the schematic diagram of FIG. 39A. With the above-mentioned eccentricity, however, the printed image will be an uneven image with stripes that appear periodically in the conveying direction as shown in FIG. 39B while the period is the same as the amount of conveying corresponding to a full rotation of the conveying roller.

The amount of eccentricity for the conveying roller is usually controlled so as to stay within a certain range. The stricter the standard for the amount of eccentricity is, the lower the yielding of the conveying roller becomes. Accordingly, the printing apparatus thus produced becomes more expensive. For this reason, an excessively strict standard for the amount of eccentricity is not preferable.

To address the above-mentioned problem, various measures have been proposed. Different correction values for the conveying errors are set for different phases of the conveying roller so that even an eccentric conveying roller can achieve a steady amount of conveying as similar to the case of a conveying roller with a perfectly-circular cross-sectional shape and with its rotation axis being aligned exactly with its central axis (Japanese Patent Laid-Open No. 2006-240055 and Japanese Patent Laid-Open No. 2006-272957). To be more specific, correction to reduce the amplitude of the fluctuation in amount of conveying with a period equivalent to the circumferential length of the conveying roller can be done by applying a periodic function with the same period and reversed polarity.

Assume that the conveying roller is manufactured within a predetermined design tolerance. Even in this case, the conveying error that derives from such factors as the amount of eccentricity and the state of eccentricity may sometimes differ between a position and another position in the longitudinal direction of the roller. A roller, which is used in a large-scale inkjet printing apparatus that can print on an A3-sized (297 mm×420 mm) or larger printing medium P, tend to have such a difference that is more prominent than those used in other types of apparatus. Thus, a correction value acquired for correcting an eccentricity-derived conveying error as to a predetermined position of the conveying roller is not always suitable for another position in the longitudinal direction of the conveying roller.

SUMMARY OF THE INVENTION

An object of the present invention is to obtain correction values with which an error in conveying a printing medium can be corrected in accordance with the size of the printing medium and thereby to contribute to the printing of a high-quality image.

In a first aspect of the present invention, there is provided a printing apparatus comprising:

a roller that conveys a printing medium;

a printing controller that controls a printing head to form a plurality of test patterns on the printing medium along a longitudinal direction of the roller, the test patterns being used to detect a conveying error of the roller; and an acquisition unit that acquires, by use of the plurality of test patterns formed on a first zone along the longitudinal direction of the roller, a first-zone correction value to correct the conveying error of the roller;

an acquisition unit that acquires, by use of a part of the plurality of test patterns that is formed on a second zone smaller than the first zone, a second-zone correction value to correct the conveying error of the roller; and a conveying controller that controls the conveying of the printing medium with the roller by applying any one of the first-zone and the second-zone correction values in accordance with a condition of the printing medium to be used.

In a second aspect of the present invention, there is provided a printing apparatus comprising:

a roller that conveys a printing medium;

a printing controller that controls a printing head to form a test patterns on the printing medium along a longitudinal direction of the roller, the test pattern being used to detect a conveying error of the roller; and an acquisition unit that acquires, by use of the test patterns formed on a first zone along the longitudinal direction of the roller, a first-zone correction value to correct the conveying error of the roller;

an acquisition unit that acquires, by use of the test patterns formed on a second zone along the longitudinal direction of the roller, the second zone being different from the first zone, a second-zone correction value to correct the conveying error of the roller; and a conveying controller that controls the conveying of the printing medium with the roller by applying any one of the first-zone and the second-zone correction values in accordance with a condition of the printing medium to be used.

In a third aspect of the present invention, there is provided a printing apparatus comprising:

a roller that conveys a printing medium;

a printing controller capable of controlling a print head to form a first test pattern on the printing medium, the first test pattern being used to detect a conveying error of the roller when a printing medium of a first size is conveyed, and a second test pattern on the printing medium, the second test pattern being used to detect a conveying error of the roller when a printing medium of a second size larger than the first size is conveyed; and a conveying controller for controlling, when the printing medium of the first size is used, the conveying of the printing medium with the roller by applying a correction value which is acquired based the first test pattern, and for controlling, when the printing medium of the second size is used, the conveying of the printing medium with the roller by applying a correction value which is acquired based the second test pattern.

The amount and the state of eccentricity of the roller may cause differences in the conveying error from a point to another in the longitudinal direction of the roller. Even in this case, according to the present invention, correction values are obtained using the whole part of or only a part of the plural test patterns formed in the longitudinal direction of the roller. The correction values thus obtained correspond to the respective zones where the plural test patterns are formed. This measure makes it possible to apply correction values that are capable of correcting the conveying errors appropriately in accordance with the size of the printing medium used for the printing. In this way, the present invention can contribute to the printing of a high-quality image.

Further features of the present invention will become apparent from the following description of exemplary embodiments with reference to the attached drawings.

BRIEF DESCRIPTION OF THE DRAWINGS

FIG. 12 illustrates, in an enlarged manner, one of the four test patterns shown in FIG. 5;

FIG. 25 is an explanatory diagram for describing the fact that the correction value for outer-diameter varies in response to the order of the acquiring of the correction value for eccentricity and the acquiring of the correction value for outer-diameter;

DESCRIPTION OF THE EMBODIMENTS

Hereafter, the present invention will be described in detail with reference to accompanying drawings.

1. Basic Configuration (1) Configuration of Apparatus

Figure 1:
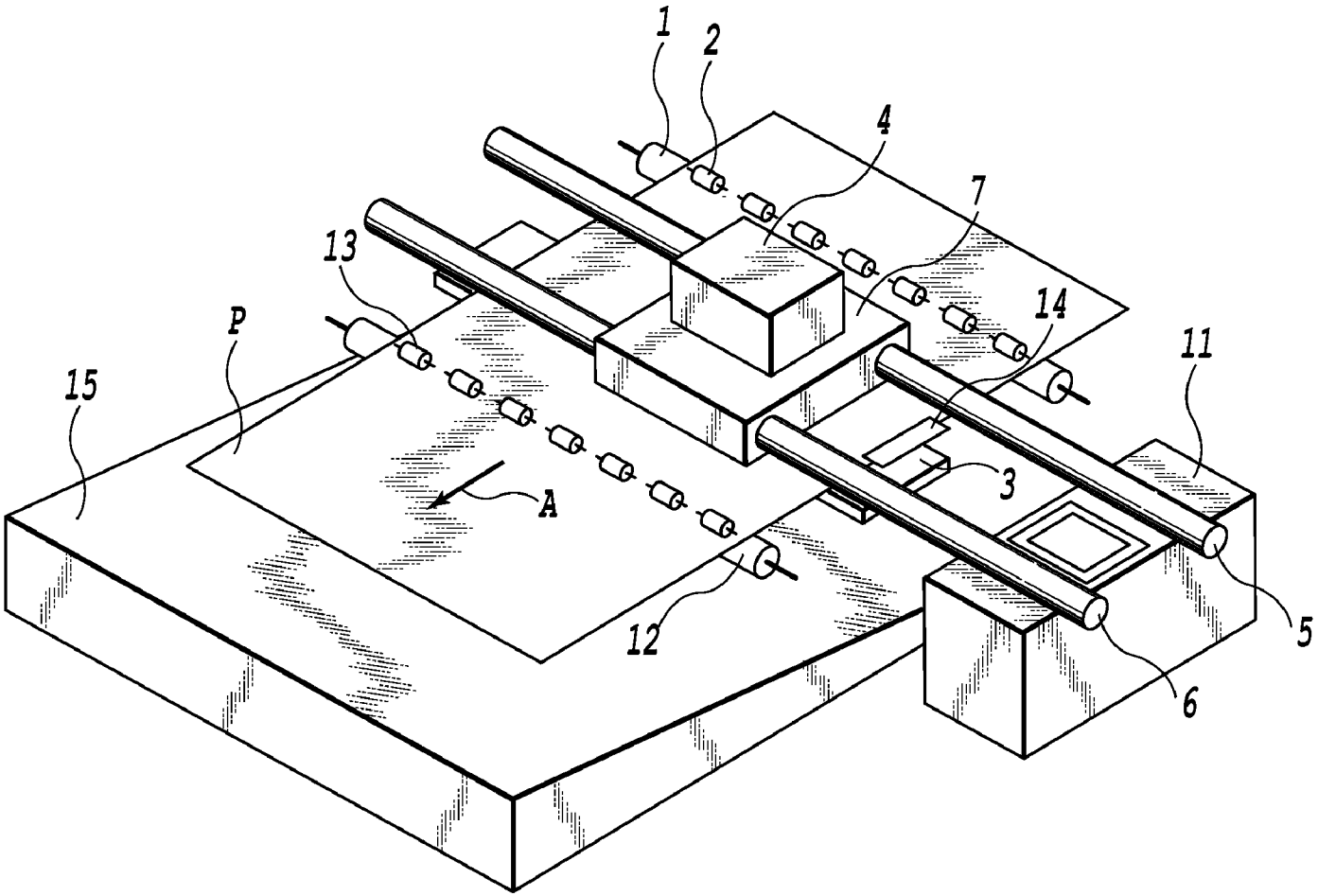
FIG. 1 is a schematic perspective view illustrating the entire configuration of an inkjet printing apparatus according to an embodiment of the present invention.

FIG. 1 is a schematic perspective view illustrating the entire configuration of an inkjet printing apparatus according to an embodiment of the present invention. When the printing is carried out, a printing medium P is held by and between a conveying roller 1—one of the plural rollers provided in the conveying path—and pinch rollers 2 that follow and are driven by the conveying roller 1. The printing medium P is guided onto a platen 3 by rotations of the conveying roller 1. The printing medium P is conveyed in a direction indicated by the arrow A in FIG. 1 while being supported on the platen 3. Though not illustrated in FIG. 1, a pressing member, such as a spring, is provided to elastically bias the pinch rollers 2 against the conveying roller 1. The conveying roller 1 and the pinch rollers 2 are components of a conveying unit on the upstream side.

The platen 3 is disposed at the printing position opposite to the face on which ejection openings are formed in a print head 4 provided in the form of an inkjet print head (hereafter the face is referred to as "ejection face"). The platen 3 thus disposed supports the back side of the printing medium P to keep a constant, or a predetermined, distance between the top surface of the printing medium P and the ejection face.

Once the printing is carried out on the printing medium P that has been conveyed onto the platen 3, the printing medium P is conveyed in the direction A, being held by and between a discharging roller 12 that rotates and spurring rollers 13 that follow and are driven by the discharging roller 12. The printing medium P is thus discharged out onto an output tray 15. The discharging roller 12 and the spurring rollers 13 are components of conveying unit on the downstream side. It should be noted that only a single pair of the discharging roller 12 and the line of spurring rollers 13 is shown in FIG. 1, but that two pairs of them may be provided as will be described later.

A member 14 is disposed by one of the side ends of the printing medium P, and is used to set the reference line when the printing medium P is conveyed (the member will, therefore, be referred to as "conveying reference member 14"). Any printing medium P, irrespective of the width thereof, is conveyed with the above-mentioned side of the printing medium along the reference line set by the conveying reference member 14. Besides the role of setting the reference line, the conveying reference member 14 may also serve the purpose of restricting the rising-up of the printing medium P towards the ejection face of the print head 4.

The print head 4 is detachably mounted on a carriage 7 with its ejection face opposing to the platen 3, or the printing medium P. The carriage 7 is driven by a driving source—a motor—to reciprocate along two guide rails 5 and 6. The print head 4 may perform ink-ejection action during the reciprocating movement. The direction in which the carriage 7 moves crosses the direction in which the printing medium P is conveyed (in the direction indicated by the arrow A). Such a direction is usually referred to as "main-scanning direction" while the direction in which the printing medium P is conveyed is usually referred to as "sub-scanning direction." The printing of images on the printing medium is carried out by repeating the alternation of main scan (printing scan) of the carriage 7, or the print head 4, and the conveying of the printing medium P (sub scan).

As the print head 4, for example, a print head that includes an element for generating thermal energy to be used for ejecting ink (an example of such element is a heat-generating resistor element) may be employed. The thermal energy causes a change in the state of the ink (that is, film boiling of the ink occurs). As another example, a print head that includes, as an element for generating energy, an element to generate mechanical energy may be employed. An example of such an element is a piezo element. The mechanical energy thus generated is used for the ejection of the ink.

The printing apparatus of this embodiment forms an image with pigment inks of ten colors. The ten colors are: cyan (C), light cyan (Lc), magenta (M), light magenta (Lm), yellow (Y), first black (K1), second black (K2), red (R), green (G), and gray (Gray). When a term "K-ink" is used, either the first black (K1) ink or the second black (K2) ink is mentioned. Here, the first and the second black inks (K1 and K2) may, respectively, be a photo black ink that is used to print a glossy image on glossy paper and a matte black ink suitable for matte coated paper without gloss.

Figure 2:
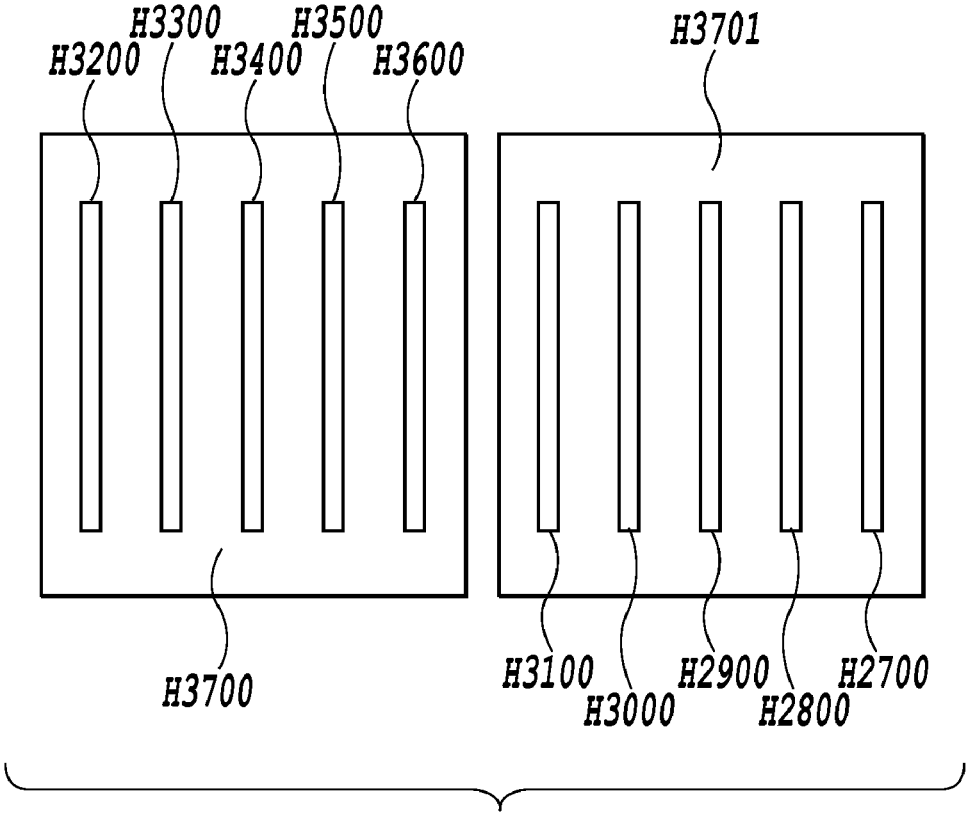
FIG. 2 is an explanatory diagram schematically illustrating a print head which is employed in the embodiment shown in FIG. 1 and which is viewed from the side of a nozzle-formed face.

FIG. 2 schematically illustrates the print head 4 used in this embodiment, and the print head 4 is viewed from the side of the nozzle-formed face. The print head 4 of this embodiment has two printing-element substrates H3700 and H3701, in each of which nozzle array for five colors of the above-mentioned ten colors formed. Each of the nozzle arrays H2700 to H3600 corresponds to each one of the ten different colors.

Nozzle arrays H3200, H3300, H3400, H3500, and H3600 are formed in one of the two substrates—specifically in the printing-element substrate H3700—to perform ink ejection with respective inks of gray, light cyan, the first black, the second black and light magenta being supplied to. Meanwhile, nozzle arrays H2700, H2800, H2900, H3000 and H3100 are formed in the other one of the two substrates—specifically, in the printing-element substrate H3701—to perform ink ejection with respective inks of cyan, red, green, magenta and yellow being supplied to. Each of the nozzle arrays is formed by 768 nozzles arranged in the direction of conveying the printing medium P at intervals of 1200 dpi (dot/inch) and ejects ink droplets each of which is approximately 3 picoliters. Each nozzle has an ejection opening with an opening area of approximately 100 $\mu m^2$.

The above-described head configuration enables what is termed as "one-pass printing" to be carried out. In this way of printing, the printing on a single area of the printing medium P is completed in a single main scanning. However, what is termed as "multi-pass printing" is also possible for the purpose of improving the printing quality by reducing the negative influence of the nozzles that are formed with lack of uniformity. In this mode of printing, the printing on a single scanning area of the printing medium P is completed by carrying out main scanning plural times. When the multi-pass printing is selected, the number of passes is determined appropriately by taking account of conditions, such as the mode of printing.

Plural ink tanks corresponding to colors of inks to be used are detachably installed in the print head 4, independently. Alternatively, the inks may be supplied to the print head 4 via respective liquid-supply tubes from the corresponding ink tanks fixed somewhere in the apparatus.

A recovery unit 11 is disposed so as to be able to face the ejection face of the print head 4. The recovery unit 11 is disposed at a position within the area that the print head 4 can reach when the print head 4 moves in the main scanning direction. The position is located outside of side-edge portion of the printing medium P, or of the platen 3. That is, the position is in an area where no image is to be printed. The recovery unit 11 has a known configuration. Specifically, the recovery unit 11 includes a cap portion for capping the ejection face of the print head 4, a suction mechanism for sucking the inks with the ejection face being capped to force the inks out of the print head 4. A cleaning blade to wipe off the tainted ink-ejection face, among other members, is also included in the recovery unit 11.

Figure 3:
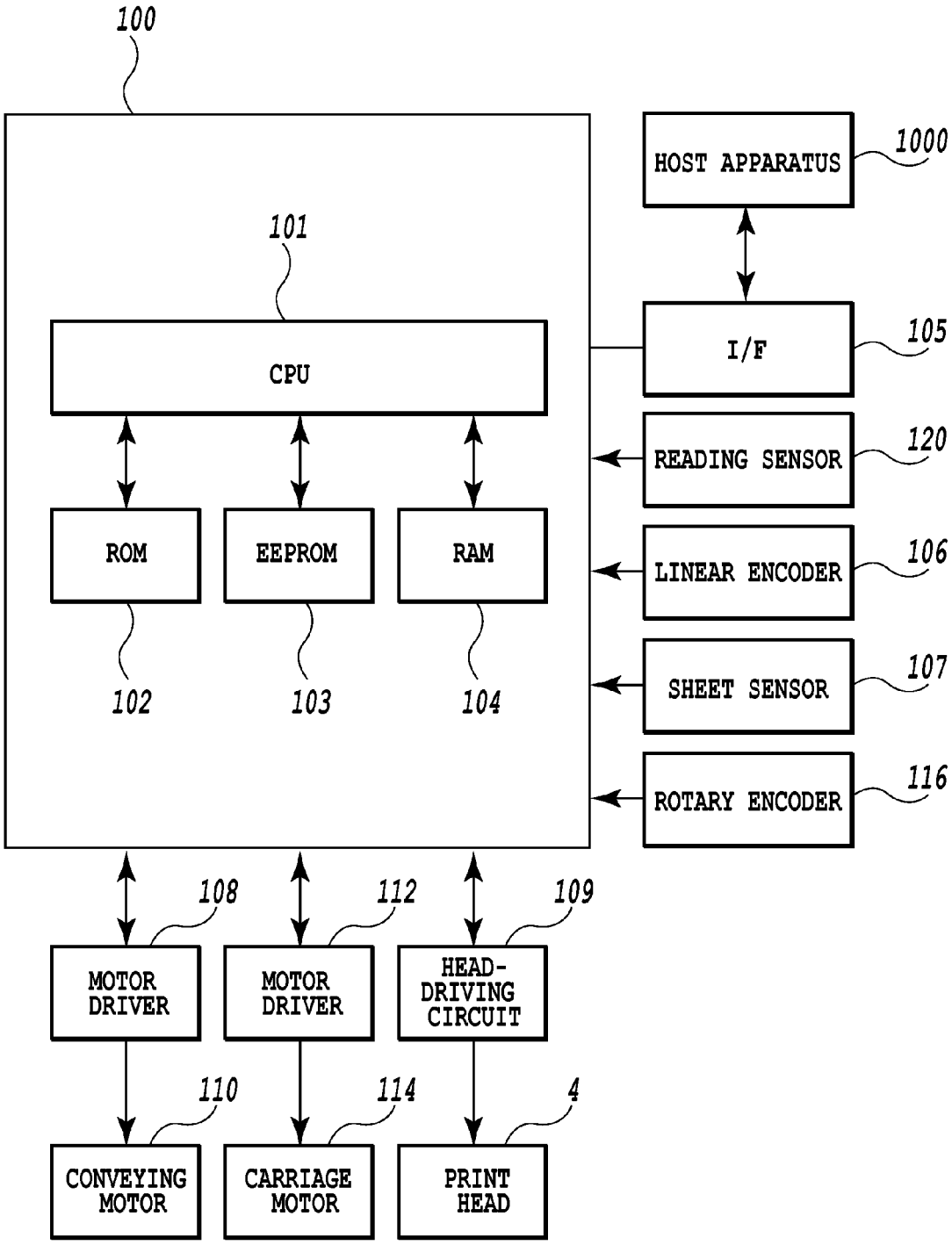
FIG. 3 is a block diagram illustrating an example of the configuration for a principal portion of a control system for the inkjet printing apparatus of FIG. 1.

FIG. 3 illustrates an example of the configuration for the principal portion of the control system for the inkjet printing apparatus according to this embodiment. A controller 100 controls each portions of the inkjet printing apparatus according to this embodiment. The controller 100 includes a CPU 101, a ROM 102, an EEPROM 103, and a RAM 104. The CPU 101 performs various arithmetic processing and determination for processing related to the printing action and the like including processing procedures that are to be described later. In addition, the CPU 101 performs the processing related to the print data and the like. The ROM 102 stores the programs corresponding to the processing procedures that are executed by the CPU 101, and also stores other fixed data. The EEPROM 103 is a non-volatile memory and is used to keep predetermined data even when the printing apparatus is switched off. The RAM 104 temporarily stores the print data supplied from the outside, and the print data developed in conformity with the configuration of the apparatus. The RAM 104 functions as a work area for the arithmetic processing performed by the CPU 101.

An interface (I/F) 105 is provided to connect the printing apparatus to an outside host apparatus 1000. Communications in both directions based on a predetermined protocol is carried out between the interface 105 and the host apparatus 1000. It should be noted that the host apparatus 1000 is provided by a known form, such as a computer. The host apparatus 1000 serves as a supply source of the print data on which the printing action of the printing apparatus of this embodiment is based. In addition, a printer driver—the program to cause the printing apparatus to execute the printing action—is installed in the host apparatus 1000. To be more specific, from the printer driver, the print data and the print set-up information, such as the information on the kind of printing medium P on which the print based on the print data is performed are sent. Also sent therefrom is the control command that causes the printing apparatus to control its action.

A linear encoder 106 is provided to detect the position of the print head 4 in the main-scanning direction. A sheet sensor 107 is provided in an appropriate position in the path of conveying the printing medium P. By detecting the front end and the rear end of the printing medium P with this sheet sensor 107, the conveying position (sub-scanning position) of the printing medium P can be determined. Motor drivers 108 and 112 and a head-driving circuit 109 are connected to the controller 100. The motor driver 108, under the control of the controller 100, drives a conveying motor 110, which serves as the driving source for conveying the printing medium P. The drive power is transmitted from the conveying motor 110 via a transmission mechanism, such as gears, to the conveying roller 1 and the discharge roller 12. The motor driver 112 drives a carriage motor 114, which serves as the driving source for the movement of the carriage 7. The drive power is transmitted from the carriage motor 114 via a transmission mechanism, such as a timing belt, to the carriage 7. The head-driving circuit 109, under the control of the controller 100, drives the print head 4 to execute the ink-ejection.

A rotary encoder 116 is mounted on each of the shafts of the conveying roller 1 and the discharge roller 12. Each of the rotary encoders 116 detects the rotational position and the speed of the corresponding roller so as to control the conveying motor 110.

A reading sensor 120 is provided to serve as detector for detecting the density of the images printed on the printing medium P. The reading sensor 120 may be provided in the form of a reading head mounted on the carriage 7 either along with or in place of the print head 4. Alternatively, the reading sensor 120 may be provided as an image-reading apparatus constructed as a body that is independent of the printing apparatus shown in FIG. 1.

(2) Outline of the Processing

In the printing apparatus with the above-described configuration, one of the biggest causes for the lowering of the accuracy in conveying is the eccentricity of a roller. The eccentricity of a roller is defined as a state where the rotational axis of a roller is offset from the central axis of the roller, that is, a state in which the axis of the rotational center of a roller deviates from the geometrical central axis of the roller. In addition, the eccentricity is defined as a state where the roller has a cross-sectional shape that is not a perfect circle. The eccentricity of a roller causes a periodical conveying error, and the period depends on the rotational angle from the reference position of the roller. Assume that such eccentricity exists. In this case, even when the roller is rotated by an equal angle, the length in the circumferential direction (lengths of arc) corresponding to the equal-angle rotation varies from one time to another. As a result, an error occurs in the amount of conveying the printing medium P. An error that occurs in this way prevents the formation, in the direction of conveying the printing medium P, of the dots in positions in which the dots are originally supposed to be formed. Dots are formed densely in some areas, and sparsely in others, in the direction of conveying the printing medium P. In summary, unevenness of printing occurs with a period equivalent to the amount of conveying corresponding to a full rotation of the roller.

Another example of the big causes for the lowering of the accuracy in conveying is a cause that derives from the error in the outer diameter of a roller. Assume that such an error in the outer diameter of a roller exists. In this case, even when the roller is rotated by a rotational angle that has been determined for a roller with a certain reference outer diameter, a predetermined amount of conveying which is supposed to be obtained cannot always be obtained. To be more specific, when a roller with an outer diameter that is larger than the reference outer diameter is used, the amount of conveying becomes larger than what is supposed to be. In this case, white stripes are likely to occur in the printed image. In contrast, when a roller with an outer diameter that is smaller than the reference outer diameter is used, the amount of conveying becomes smaller than what is supposed to be. In this case, black stripes are likely to occur in the printed image.

In view of what has just been described above, this embodiment of the present invention aims to provide a configuration that is capable of reducing variations in positions of dot formation, which derives from the lack of accuracy in conveying due to such causes as the eccentricity of the conveying roller 1 and of the discharge roller 12 as well as the errors in outer diameter of these rollers. For this purpose, in this embodiment, a first correction value is acquired to reduce the negative influence of the eccentricity of the rollers (hereafter, the first correction value is referred to as "correction value for eccentricity"). In addition, a second correction value is acquired to reduce the negative influence of the outer-diameter error (hereafter, the second correction value is referred to as "correction value for outer-diameter"). Then, these correction values are used to control the rotation of the rollers, or to be more precise, to control the driving of the conveying motor 110 when the printing is actually carried out.

Figure 4:
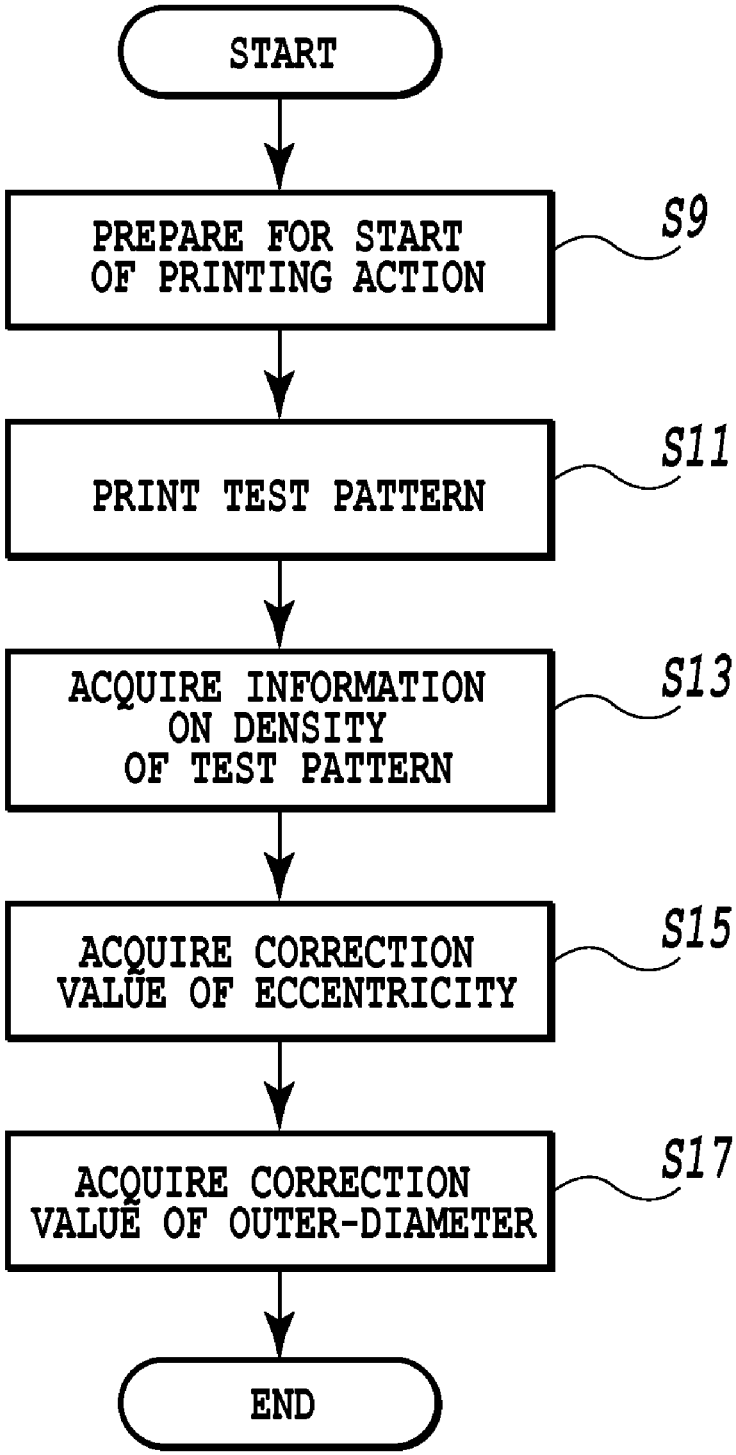
FIG. 4 is a flowchart illustrating an outline of processing procedure to acquire a correction value for eccentricity and a correction value for outer-diameter according to the embodiment of the present invention.

FIG. 4 is a flowchart illustrating the outline of processing procedures to acquire the correction value for eccentricity and the correction value for outer-diameter. In this procedure, firstly, preparation for the start of printing action including the setting and the feed of the printing medium P is done (step S9). When the printing medium P is conveyed to a predetermined position for the printing, test patterns are printed (step S11). With these test pattern, simultaneous detection of the errors in the amount of conveying caused by both the eccentricity and the outer-diameter error (hereafter, also referred to as "conveying error") is possible, and detail descriptions of the test patterns will be given later.

Subsequently, the test pattern is read using the reading sensor 120, and the information on the density of the test pattern is acquired (step S13). Then, on the basis of this density information, the acquiring of the correction value for eccentricity (step S15) and the acquiring of the correction value for outer-diameter (step S17) are carried out in this order.

(3) Test Pattern

Figure 5:
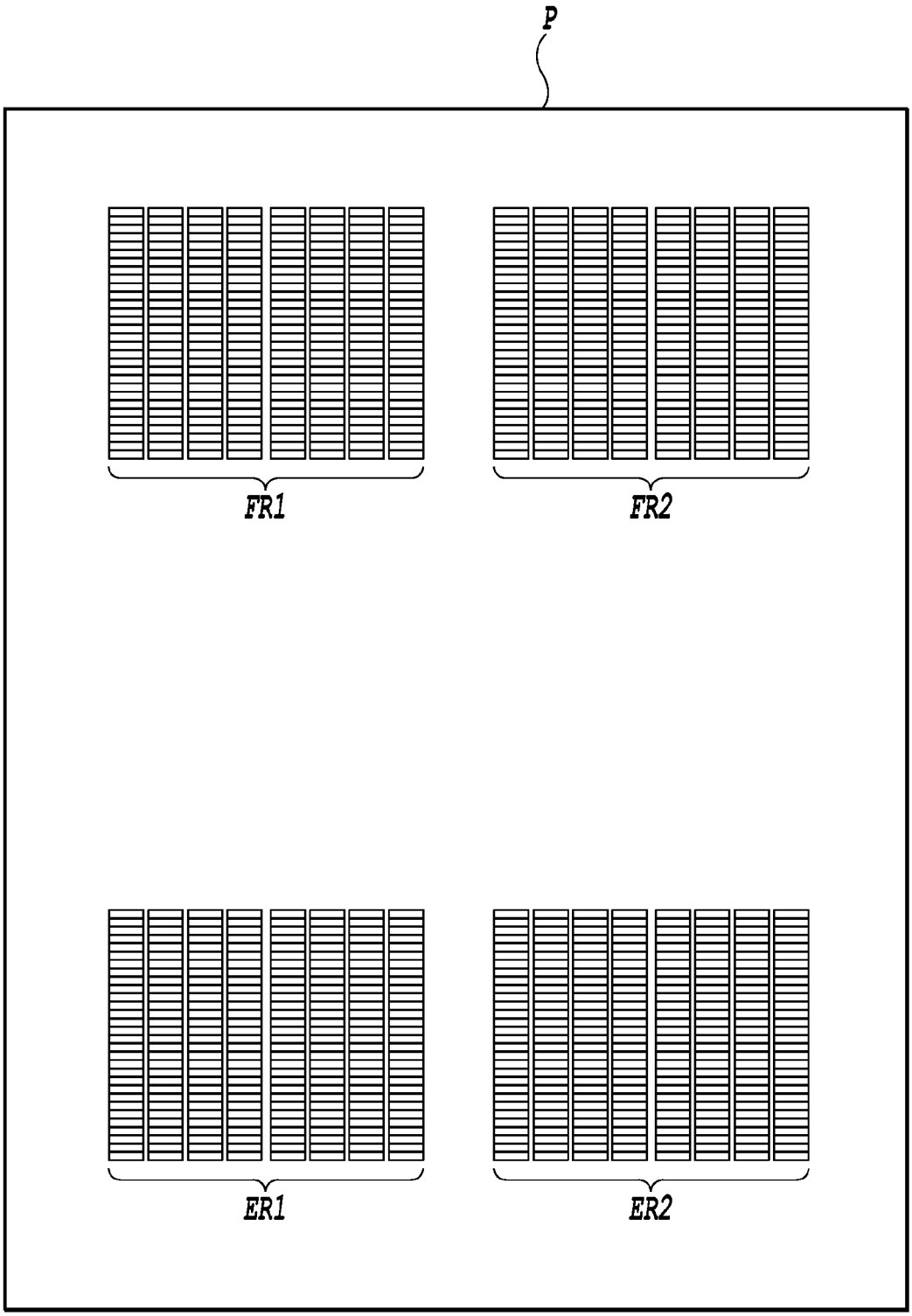
FIG. 5 is an explanatory diagram illustrating an example of the test patterns used in this embodiment.

FIG. 5 illustrates an example of the test patterns used in this embodiment. In this embodiment, test patterns used to detect the conveying error caused by the conveying roller 1 and test patterns used to detect the conveying error caused by the discharge roller 12 are formed side by side with each other in a direction, which is corresponding to the direction of conveying the printing medium P, that is, in the sub-scanning direction. Two test patterns are formed side by side with each other in a direction corresponding to the direction of the rotational axis of each roller, that is, in the main-scanning direction. One of the two test patterns is formed in a position near the conveying reference member 14, and the other is formed in a position far from the conveying reference member 14, so as to detect the conveying errors of the corresponding roller in the respective positions. To be more specific, in FIG. 5, a test pattern FR1 is provided to detect the conveying error of the conveying roller 1 in a position near the conveying reference member 14, and a test pattern ER1 is provided to detect the conveying error of the discharge roller 12 in a position near the conveying reference member 14. In addition, a test pattern FR2 is provided to detect the conveying error of the conveying roller 1 in a position far from the conveying reference member 14, and a test pattern ER2 is provided to detect the conveying error of the discharge roller 12 in a position far from the conveying reference member 14.

Now, some of the reasons why the test patterns for both the conveying roller 1 and the discharge roller 12 are printed will be given in the paragraphs that follow.

Figure 6A:
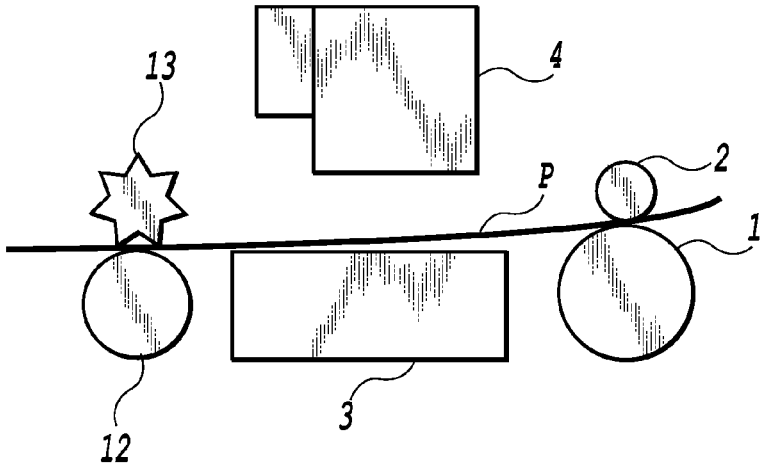
FIGS. 6A and 6B are explanatory diagrams for describing different states in which the printing medium is conveyed.
Figure 6B:
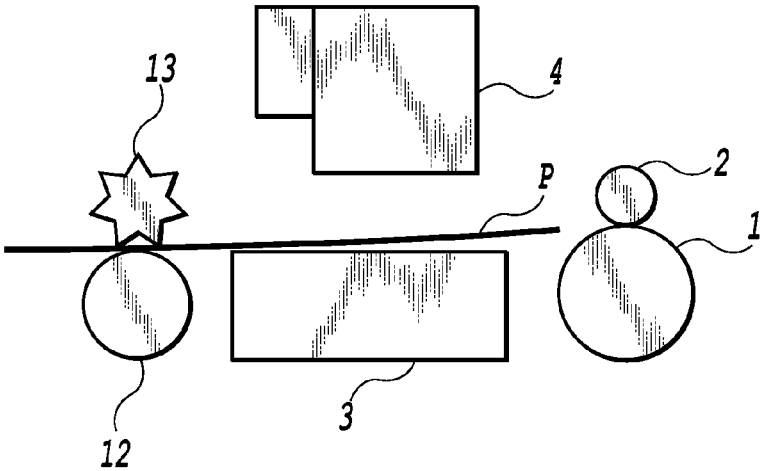

In the printing apparatus according to this embodiment, conveying units are respectively provided at the upstream and the downstream sides, in the direction of conveying the printing medium P, of the position where the printing is executed by the print head 4 (printing position). Accordingly, the printing medium P can be in any one of the following three states: first, the printing medium P is supported and conveyed by the upstream-side conveying unit alone: second, the printing medium P is supported and conveyed by the conveying units on both sides (FIG. 6A); and third, the printing medium P is supported and conveyed by the downstream-side conveying unit alone (FIG. 6B).

The conveying roller 1 and the discharge roller 12 have their respective main functions that are different from each other. So, the conveying accuracy of the conveying roller 1 frequently differs from that of the discharge roller 12. The main function of the conveying roller 1 is to set the printing medium P, for each stage of the printing scan action, in an appropriate position for the print head 4. Accordingly, the conveying roller 1 is formed with a roller diameter that is large enough to carry out the conveying action with relatively high accuracy. In contrast, the main function of the discharge roller 12 is to discharge the printing medium P with certainty when the printing on the printing medium P is finished. So, most frequently, the discharge roller 12 cannot rival the conveying roller 1 in the accuracy of conveying the printing medium P.

As evident from what has been described above, when the conveying roller 1 is actually involved in the action of conveying the printing medium P, the conveying accuracy for the conveying roller 1 affects the error of conveying the printing medium P. When, in contrast, only the discharge roller 12 is involved in the action of conveying the printing medium P, the conveying accuracy for the discharge roller 12 affects the error of conveying the printing medium P.

Figure 7:
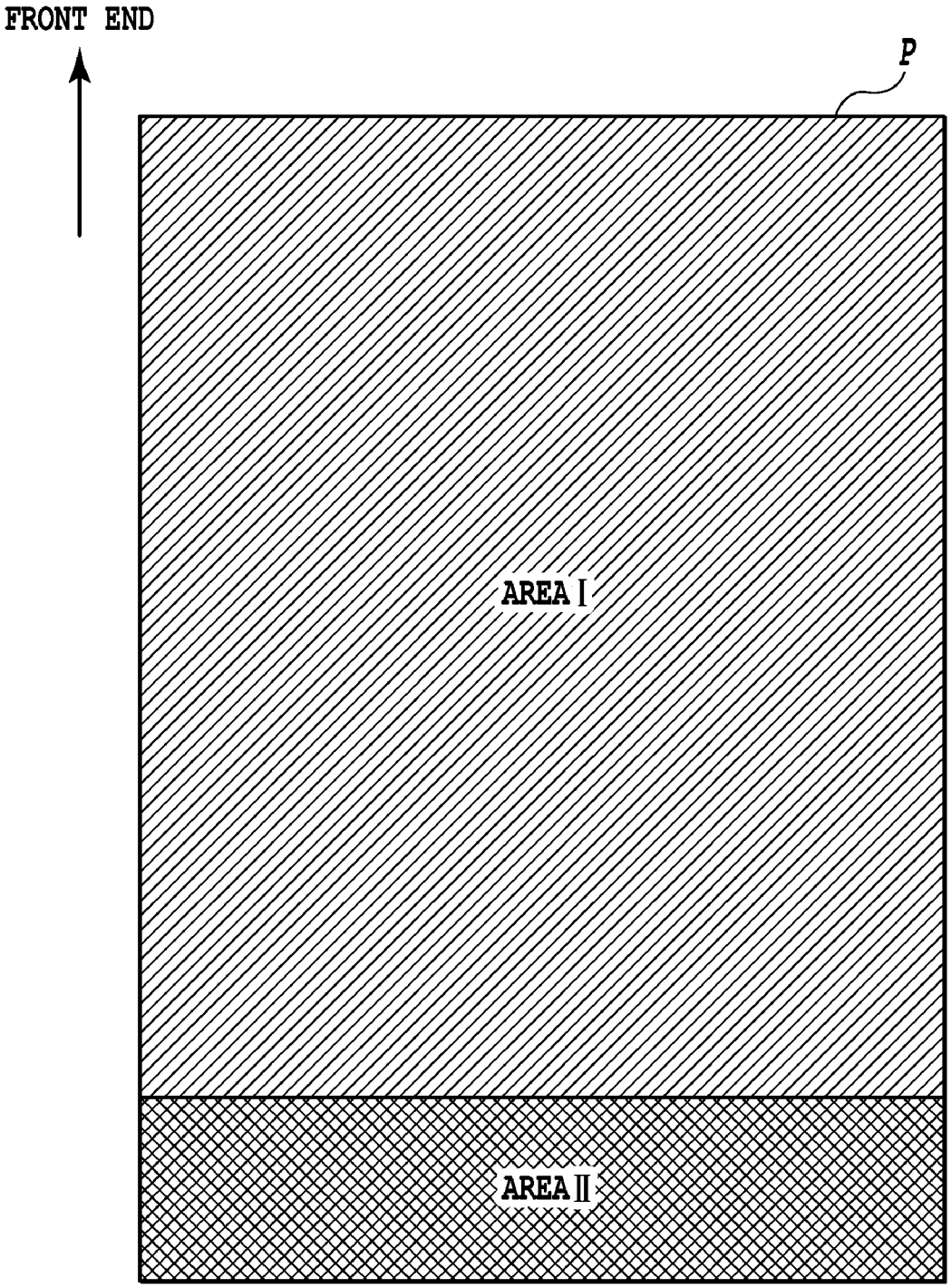
FIG. 7 is an explanatory diagram for describing an aspect where the entire printing area of the printing medium is divided into two areas: an area on which the printing is done with the upstream-side conveying unit being involved in the action of conveying the printing medium; and another area on which the printing is done with the printing medium is conveyed by the downstream-side conveying unit alone.

That is why, in this embodiment, the printing medium P is divided into two areas—an area I and an area II—as shown in FIG. 7. For the printing on the area I, the conveying roller 1 is involved in the conveying action. Meanwhile, the printing medium P is conveyed by the discharge roller 12 alone when the printing is done on the area II. The test patterns are printed while the printing medium P is conveyed by the rollers that are mainly involved in the conveying action for the printing on the respective areas I and II. From each of the test patterns, information on the density is acquired, and thus the correction values that are used in the actual printing of the respective areas are acquired. Incidentally, the printing apparatus according to this embodiment is designed to be capable of printing an image with no margins, that is, "marginless printing" in the front-end portion or in the rear-end portion of the printing medium P. The correction value is usable when the marginless printing is performed in the rear-end portion of the printing medium P. For this reason, acquiring the correction value for the occasion where the printing medium P is conveyed by the discharge roller 12 alone is useful.

Figure 6C:
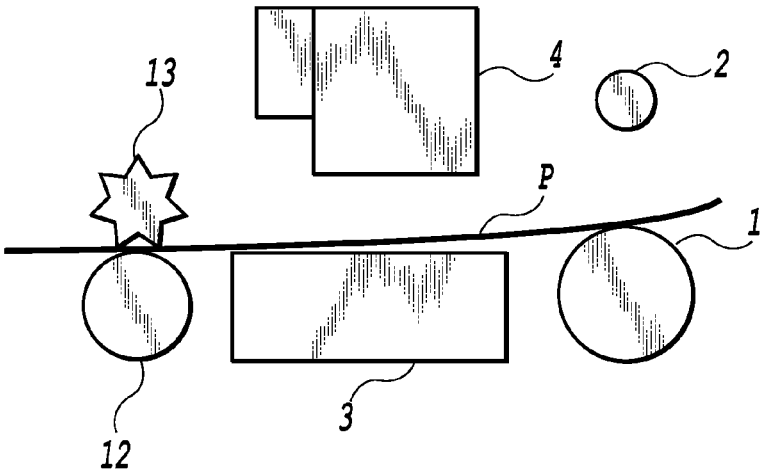
FIG. 6C is an explanatory diagram for describing the state in which the printing medium is released from an upstream-side conveying unit and comes to be conveyed by a downstream-side conveying unit alone.

FIG. 6B illustrates a state where the printing apparatus performs an actual printing action with the printing medium P being conveyed by the downstream-side conveying unit alone. In this case, the area where the test patterns used for detecting the conveying error of the discharge roller 12—specifically, the test patterns ER1 and ER2—are printed is limited to the area II. So, to secure an enough area to be used for this purpose, a state shown in FIG. 6C—the state where the printing medium P is conveyed by the downstream-side conveying unit alone—can be artificially created by releasing the pinch rollers 2 when the printing of the test patterns FR1 and FR2 is finished. This releasing may be done manually. Alternatively, the releasing action may be automatically executed by the printing apparatus configured as such.

When the printing medium P is conveyed by both the conveying roller 1 and the discharge roller 12, the conveying accuracy for the conveying roller 1 has a predominant influence on the conveying error. For this reason, the entire printing area is divided into such two areas as described above. However, the conveying error in a case where the conveying roller 1 alone is involved in the conveying of the printing medium P (printing is performed on the front-end portion of the printing medium P) may differ from the conveying error in a case where both the conveying roller 1 and the discharge roller 12 are involved in the conveying. Then, the area corresponding to both of the above-mentioned cases may be divided further into smaller portions to be processed independently.

Figure 8:
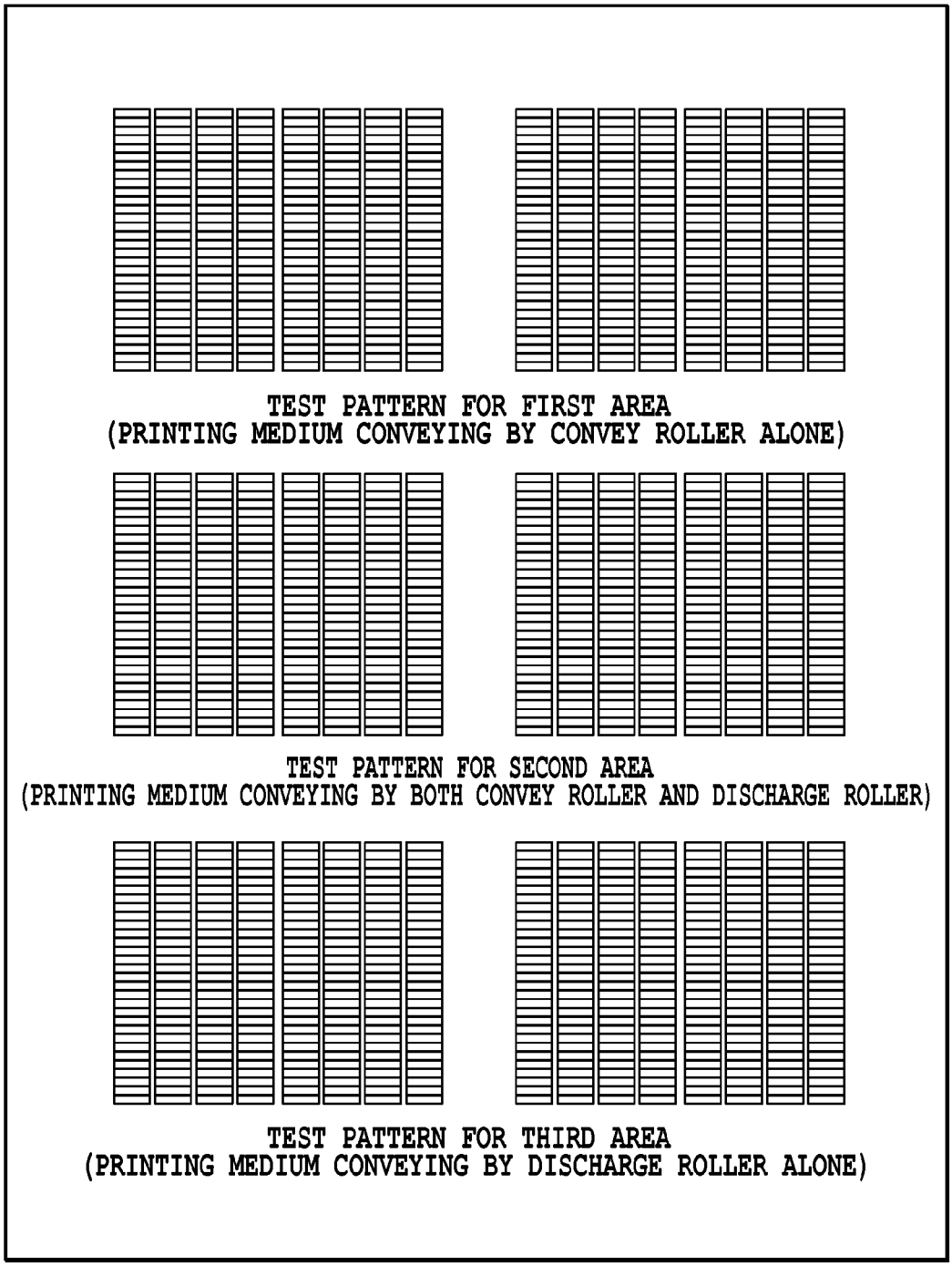
FIG. 8 is an explanatory diagram illustrating another example of test patterns applicable to the embodiment of the present invention.

To be more specific, as shown in FIG. 8, the area I can be, firstly, divided into two portions—a portion corresponding to the conveying done by the conveying roller 1 alone and another portion corresponding to the conveying done by both the conveying roller 1 and the discharge roller 12. Then, test patterns are printed individually in both portions, and the density information and the correction values are acquired for each of the portions. In this case, to secure enough space to print test patterns corresponding to the state where the printing medium P is conveyed by the conveying roller 1 alone, the spurring rollers 13 may be designed to be released from the discharge roller 12.

Now, some of the reasons why the test patterns for each of the conveying roller 1 and the discharge roller 12 are formed both in a position near the conveying reference member 14 and in a position far from the conveying reference member 14 will be given in the following paragraph.

Assume that each roller is manufactured within a predetermined design tolerance. Even in this case, the conveying error that derives from such factors as the amount of eccentricity and the state of eccentricity may sometimes differ between a position on the side of the printing apparatus near the conveying reference member (a position on the conveying-reference side) and a position on the side thereof far from the conveying reference member (a position on the non-conveying-reference side). Rollers, which are used in a large-scale inkjet printing apparatus that can print on an A3-sized (297 mm×420 mm) or larger printing medium P, tend to have such a difference that is more prominent than those used in other types of apparatus. A possible way to minimize the difference in the conveying error between a position on the conveying-reference side and a position on the non-conveying-reference side is that a single test pattern is printed in the central position in the main-scanning direction, that is, in the longitudinal direction of the roller, and then a correction value is acquired from the information on the density of the test pattern. In this embodiment, however, plural test patterns are printed in the main-scanning direction (for example, two test patterns are printed in this embodiment, but three, or more, are also allowable). Then, having compared those printed test patterns, a correction value is selected so as to reduce most the negative influence of the conveying error on the test pattern that is affected most prominently by the corresponding conveying error (this will be described later)

(4) Details of Test Pattern

Each of the test patterns shown in FIG. 5 is formed in the following way.

Figure 9:
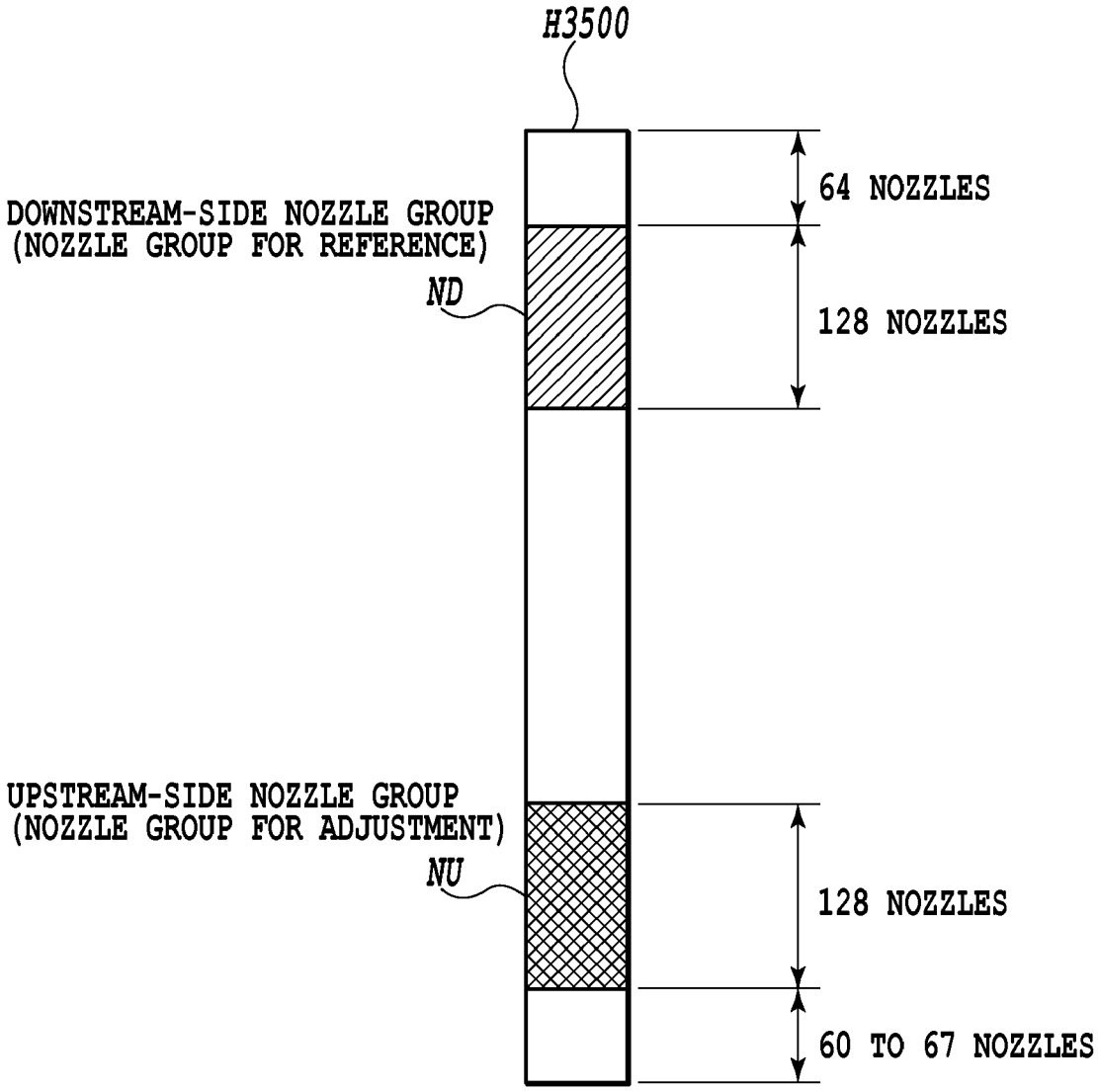
FIG. 9 is an explanatory diagram for describing the way how nozzles are used when the test patterns are formed.
Figures 10A, 10B, 10C, 10D, 10E:
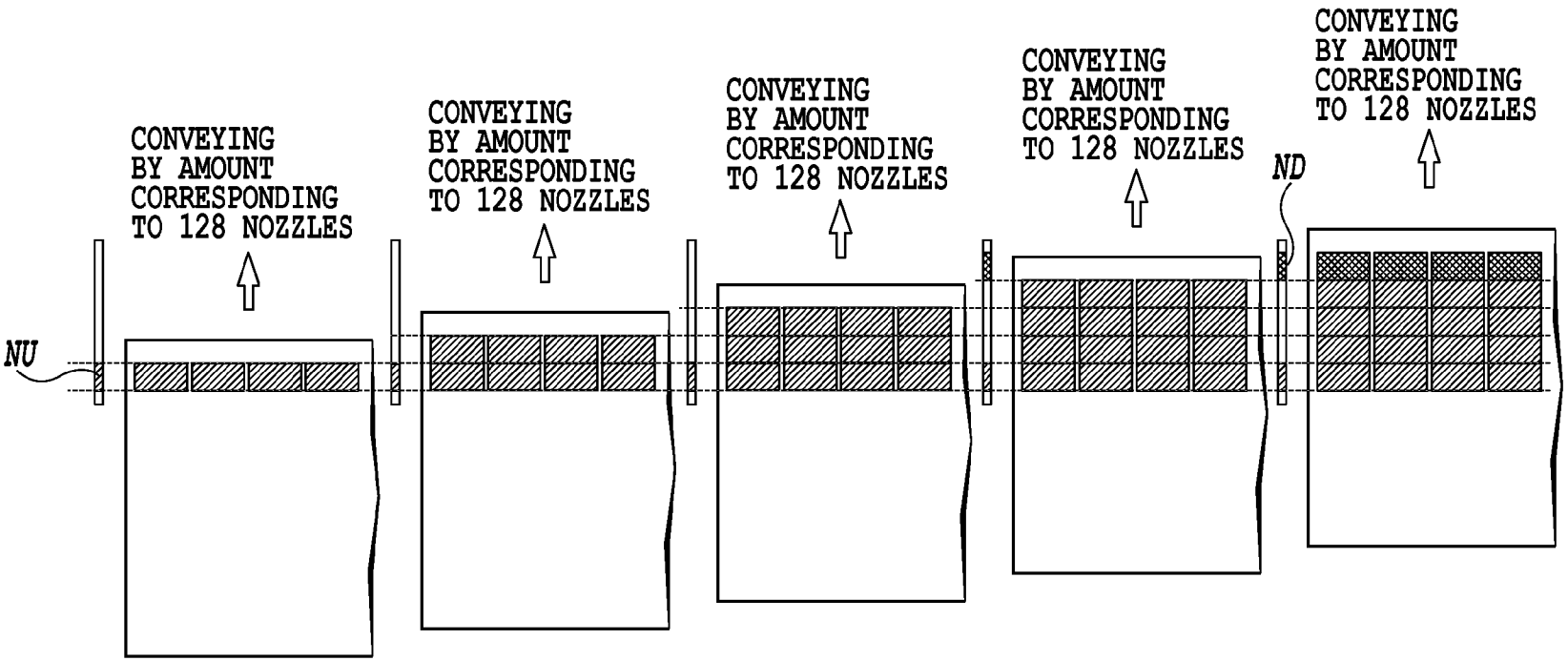
FIGS. 10A to 10E are explanatory diagrams for describing the way how the test patterns, or the patches constituting the test patterns, are formed by using the upstream-side nozzle group NU and the downstream-side nozzle group ND.

FIG. 9 is an explanatory diagram for describing the way how the nozzles are used when the test patterns are formed. When the test patterns are formed, by using, amongst the 768 nozzles included in the nozzle array H3500 for the second black ink, for example, a nozzle group NU that consists of a part of the 768 nozzles consecutively formed on the upstream side in the conveying direction and another nozzle group ND that consists of a part of the 768 nozzles consecutively formed on the downstream side in the conveying direction. The nozzle groups NU and ND are located with an in-between distance that is equal to each amount of conveying between every two printing scans multiplied by the number of printing scans done until patch elements, which are to be described later, are laid over each other. In this embodiment, the nozzle group located on the downstream side (the nozzle group ND) is made to be the nozzle group for reference, and 128 nozzles located in a range from the 65th to 193rd nozzle counted from the nozzle located in the most downstream position are used, in a fixed manner, to print plural patch elements for reference RPEs (first patch elements). The nozzle group located on the upstream side (the nozzle group NU) is made to be the nozzle group for adjustment. The number of nozzles, amongst the nozzle group NU, to be used is 128, which is the same number of nozzles to be used amongst those in the nozzle group ND. However, the range of nozzles of the nozzle group NU is shifted by one nozzle during the main scan. In this way, plural patch elements for adjustment APEs (second patch elements) are printed.

FIGS. 10A to 10E are explanatory diagrams for describing the way how the test patterns, or the patches constituting the test patterns, are formed by using the upstream-side nozzle group NU and the downstream-side nozzle group ND. Firstly, patch elements for adjustment is formed in a main scan at a certain conveying position (that is, by the first main scan), then printing medium P is conveyed by an amount corresponding to 128 nozzles, and thereafter patch elements for adjustment are further formed. When the above-described series of actions are repeated, the first ones of the patch elements for adjustment thus formed reach the position where the downstream-side nozzle group ND is located at the time of the fifth main scan. By forming patch elements for reference at this position, patches that are used to acquire the density information (the kind of patches of the first line) are completed.

Likewise, at the sixth main scan, the patch elements for adjustment formed at the second main scan reach the position where the downstream-side nozzle group ND is located. By forming patch elements for reference at this position, patches of the second line are completed. Patches of the third line onwards are formed in a similar way, and thus plural lines of patches are completed in the sub-scanning direction.

The above descriptions show that, to complete the patches, four times of conveying the printing medium P are necessary to be carried out between the scan to form the patch elements for adjustment and the scan to form the patch elements for reference. Accordingly, each of the patches reflects the conveying error caused by the sector of the roller used in the four times of conveying the printing medium P, which are carried out between the scan having formed the patch elements for adjustment and the scan having formed the patch elements for reference.

Figure 11A:
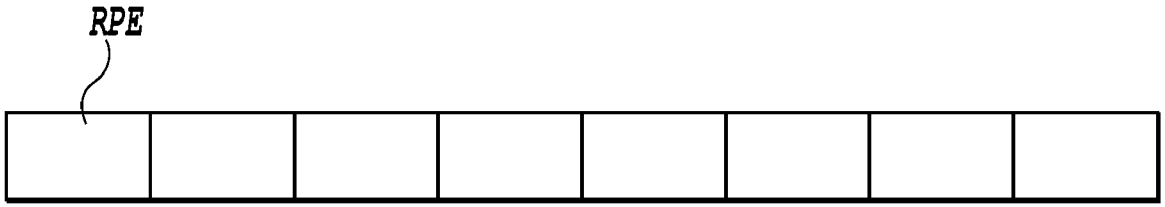
FIGS. 11A and 11B are explanatory diagrams of, respectively, a patch element group for reference and a patch element group for adjustment each of which group is printed by a single main scan.
Figure 11B:
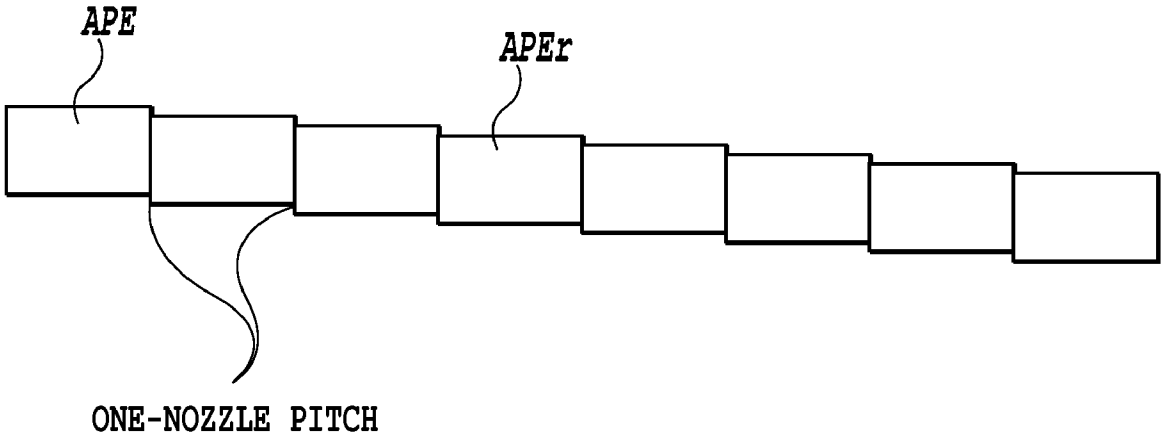

FIGS. 11A and 11B illustrate, respectively, a group of patch elements for reference printed by a single main scan and a group of patch elements for adjustment printed likewise. As FIG. 11A shows, the patch elements for reference RPEs are printed neatly in a line in the main-scanning direction. In contrast, FIG. 11B shows that when the patch elements for adjustment APEs are printed, each of the patch elements for adjustment APEs is shifted by a pitch corresponding to one nozzle. The group of patch elements for adjustment APEs includes a standard patch element for adjustment APEr that is printed by using 128 nozzles located in a range from the 65th nozzle to the 193rd nozzles that are counted from the nozzle located in the most upstream position.

The patch elements for adjustment APEs that are located closer to the conveying reference member 14 than the standard patch element for adjustment APEr are shown at the left side of the standard patch element for adjustment APEr in FIG. 11B. Each such patch element for adjustment APE is printed by using the nozzle group for adjustment NU, but the range of nozzles used to print a patch element for adjustment is shifted, by one nozzle towards the downstream side of the conveying, from the range of nozzles used to print the adjacent patch element for adjustment APE that is located at the right side thereof. The patch elements for adjustment APEs that are located farther from the conveying reference member 14 than the standard patch element for adjustment APEr are shown at the right side of the standard patch element for adjustment APEr in FIG. 11B. Each such patch element for adjustment APE is printed by using the nozzle group for adjustment NU, but the range of nozzles used to print a patch element for adjustment is shifted, by one nozzle towards the upstream side of the conveying, from the range of nozzles used to print the adjacent patch element for adjustment APE that is located at the left side thereof. The range of nozzles is shifted by 3 nozzles for the conveying-reference side and by 4 nozzles for the non-conveying-reference side. When the shifting towards the upstream side is denoted as positive, the range of shifting, as a whole, is from −3 to +4.

Now, assume that the printing medium P is conveyed between two main scans, without any error, by a distance corresponding to a range of 128 nozzles arranged at a pitch of 1200 dpi (128/1200×25.4=2.709 [mm]). Then, the patch elements for reference RPEs that are printed at the fifth main scan is laid exactly over the standard patch element for adjustment E APEr (shifting amount=0) printed at a main scan after the printing medium P is conveyed four times. Note that a positive amount of shifting corresponds to a case where the amount of conveying is larger than the above-mentioned distance while a negative amount of shifting corresponds to a case where the amount of conveying is smaller than the above-mentioned distance.

Figure 12:
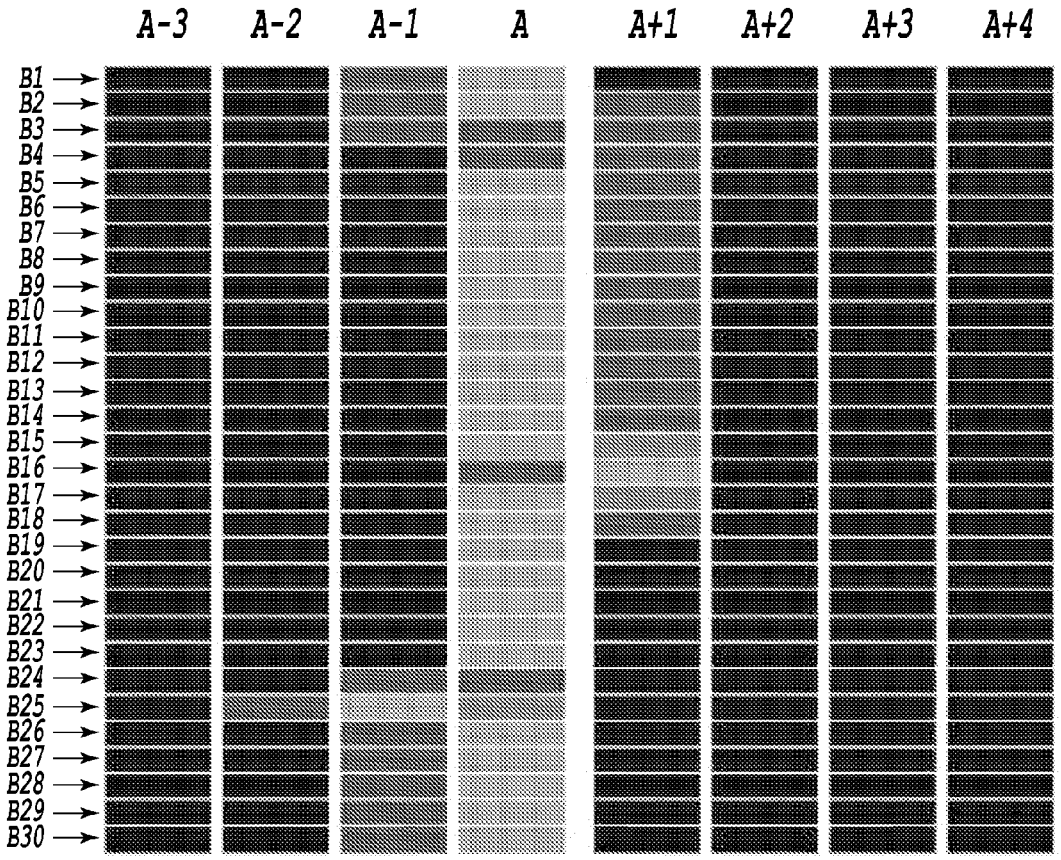
FIG. 12 is an explanatory diagram illustrating a test pattern including a group of patches each of which is composed of a patch element for reference and a patch element for adjustment.

FIG. 12 illustrates a test pattern including plural patch elements, or including a group of patches each of which is composed of a patch element for reference and a patch element for adjustment. FIG. 12 illustrates, in an enlarged manner, one of the four test patterns shown in FIG. 5.

With the standard patch element for adjustment APEr, patch elements for adjustment APEs are printed by with the nozzles actually used for printing being shifted, by one nozzle, from the respective adjacent ones within a range from −3 to +4 nozzles. Accordingly, in each test pattern, 8 patches are formed in the main-scanning direction. In addition, the amount of conveying the printing medium P, in this embodiment, between each two main scans is set at 2.709 mm (as an ideal value). Main scans are repeatedly carried out 30 times in total to form 30 patches across the range in the sub-scanning direction (in the direction of conveying the printing medium P). Accordingly, each test pattern has a length in the sub-scanning direction of 2.709×30=81.27 mm (as an ideal amount). When a roller has, nominally, an outer diameter of 37.19 mm, the above-mentioned length of the test pattern corresponds to more than twice the circumference of the roller.

A patch column A shown in FIG. 12 includes the reference patch elements for adjustment APErs. Each of patch columns marked with A+1 to A+4 includes patch elements for adjustment APEs printed with the used range of the nozzle group for adjustment NU being shifted towards the upstream side in the direction of conveying the printing medium P from the reference patch elements for adjustment APErs by an amount corresponding to 1 nozzle to 4 nozzles. Each of patch columns marked with A-1 to A-3 includes patch elements for adjustment APEs printed with the used range of the nozzle group for adjustment NU being shifted towards the downstream side in the direction of conveying the printing medium P from the reference patch elements for adjustment APErs by an amount corresponding to 1 nozzle to 3 nozzles.

Patch rows B1 to B30 are formed with different sectors of the roller used to convey the printing medium P between the scan to form each patch element for adjustment APE and the scan to form the corresponding patch element for reference RPE. Assume that the conveying of the printing medium P after the printing of the patch element for adjustment APE of the patch row B1 is carried out from a reference position of the roller. In this case, for the patch row B1, the sector of the roller used between the scan to print the patch element for adjustment (APE) and the scan to print the patch element for reference (RPE) corresponds to a sector of the roller used to convey the printing medium P four times (0 mm to 10.836 mm) starting from the reference position of the roller. For the patch row B2, the sector of the roller used between the scan to print the patch element for adjustment (APE) and the scan to print the patch element for reference (RPE) corresponds to a sector of the roller used to convey the printing medium P four times (2.709 mm to 13.545 mm) starting from a position away from the reference position by 2.709 mm. Likewise, for the patch row B3, a sector of the roller (5.418 mm to 18.963 mm) is used, while for the patch row B4, another sector of roller (8.127 mm to 21.672 mm). In this way, for the different patch rows, different sectors of the roller are used between the scan to print the patch element for adjustment (APE) and the scan to print the patch element for reference (RPE).

In addition, patch rows that are adjacent to each other share, partially, a sector of the roller to be used between the scan to print the patch element for adjustment (APE) and the scan to print the patch element for reference (RPE). For example, both of the patch rows B1 and B2 use a common sector of the roller (2.709 mm to 10.836 mm).

The position of conveying after the printing of the patch element for reference (RPE) of the patch row B1 may be aligned with the reference position of the roller. In the formation of the test pattern, however, no such control as to make the above state accomplished is necessary. Alternatively, the conveying position after the printing of the patch element for reference of the patch row B1 may be printed and may be used as the reference to acquire the relations between the patch rows (positions to be used within a roller) and the conveying error, which relations are to be described later.

(5) Details of Patch

Figure 13:
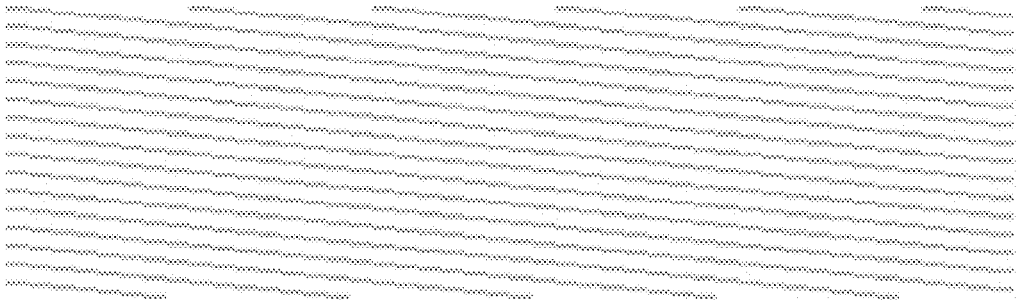
FIG. 13 is an explanatory diagram illustrating an enlarged patch element for reference or for adjustment.
Figure 14:
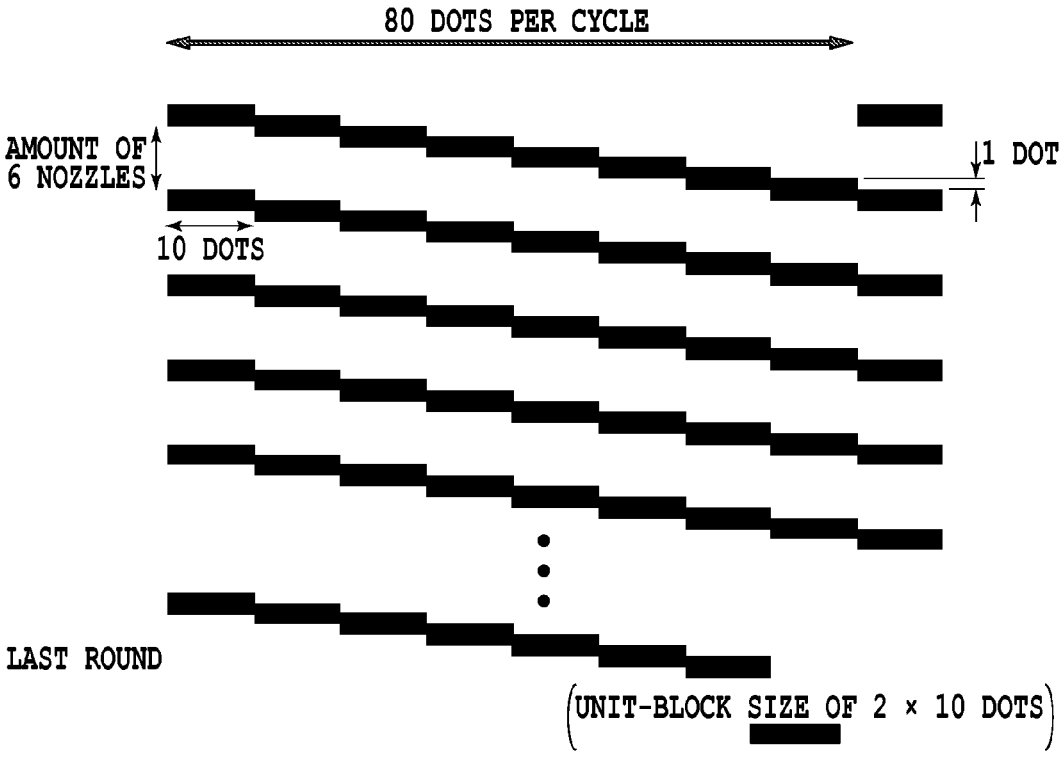
FIG. 14 is an explanatory diagram illustrating the patch element of FIG. 13 in a further enlarged manner.

FIG. 13 illustrates the patch element for reference or the patch element for adjustment in enlarged manner. In FIG. 14, the patch element is illustrated in a further enlarged manner. The patch element is formed in a stair-shaped pattern with print blocks, as base units, each of which has dimensions of 2 dots in the sub-scanning direction and 10 dots in the main-scanning direction. In addition, a certain distance in the sub-scanning direction between each two stair-shaped patterns is secured by taking account of the range for shifting the group of nozzles to be used. In the example shown in FIG. 14, the group of nozzles to be used is shifted by 1 to 4 nozzles towards the upstream side of the conveying direction (+1 to +4) and by 1 to 3 nozzles towards the downstream side in the conveying direction. In response to this, a space of 6 nozzles is secured in the sub-scanning direction.

In this embodiment, such a patch element as shown in this drawing is printed in the upstream-side nozzle group NU and in the downstream-side nozzle group ND as well. Accordingly, the state of overlaying of the patch element for reference (RPE) and the patch element for adjustment (APE) is changed in response to the degree of conveying errors. As a result, in the test pattern, patches of various densities are formed as shown in FIG. 12.

Figure 15A:
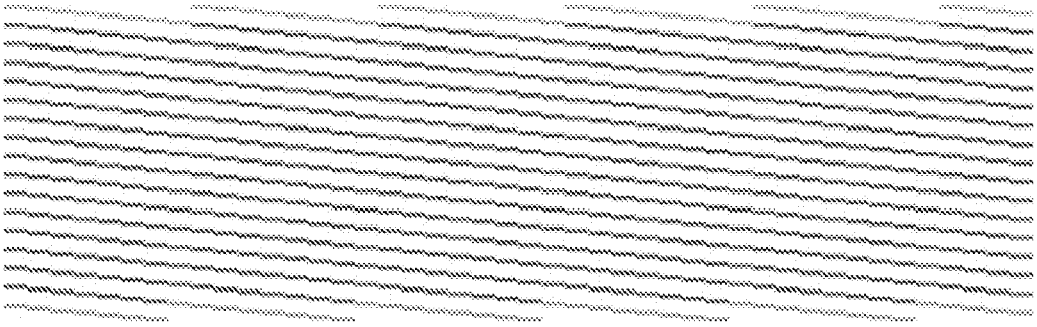
FIGS. 15A and 15B are explanatory diagrams for describing the change in density caused by the interference between the patch element for reference and the patch element for adjustment.
Figure 15B:
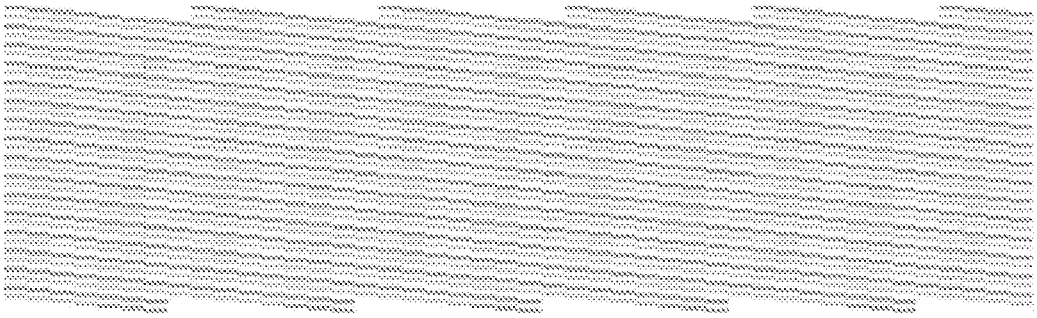

Specifically, when the patch element for adjustment (APE) printed by the upstream-side nozzle group NU and the patch element for reference (RPE) printed by the downstream-side nozzle group ND are aligned exactly with each other as shown in FIG. 15A, the density (OD value) becomes low. In contrast, when these patches are misaligned as shown in FIG. 15B, the space that is supposed to be blank is filled, so that the density becomes high.

The reliability of the test pattern has to be enhanced so that the conveying error can be detected from the information on the density of the test pattern. To this end, it is preferable that the state of the nozzles of the print head 4 be less likely to affect the patches. In nozzles that are used continuously or used under certain conditions, such ejection failure as deflection in the ejection direction (dot deflection) and no ejection of ink may sometimes occur. When such ejection failure brings about a change in the information on the density of the patches, the correction value for conveying error can be calculated only incorrectly. It is, therefore, strongly desirable that patches to be formed are capable of reducing the change in information on the density even with the existence of such ejection failure as mentioned above. The patch element employed in this embodiment can respond such a demand. The reason for this will be described in the following paragraphs by using a simple model.

Figures 16A, 16B:
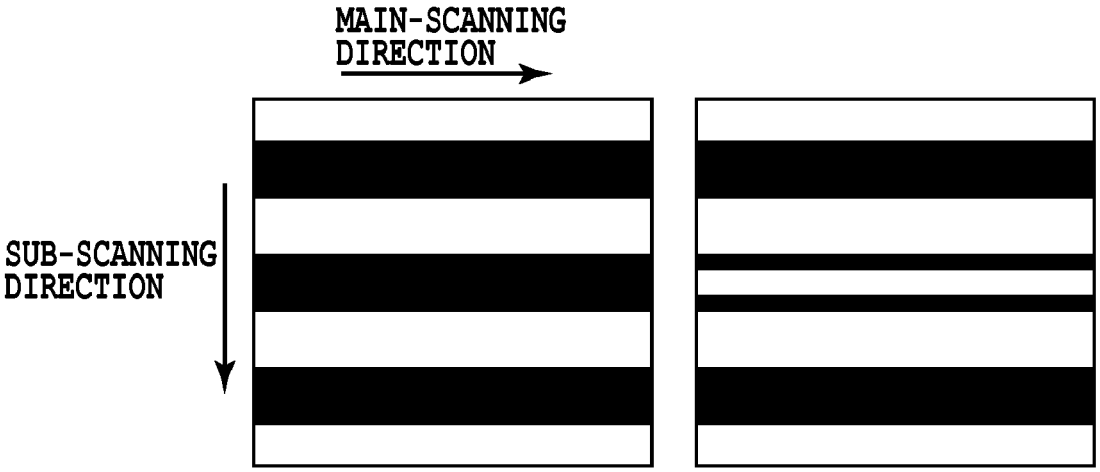
FIGS. 16A and 16B are explanatory diagram for describing a problem caused by ejection failure that occurs in the nozzles used to form the test pattern.

The patch element is formed in a pattern with spaces in the sub-scanning direction as shown in FIG. 16A so that the amount of offset in positions can be measured as the information on the density. However, when a particular nozzle does not eject any ink at all, all the area that is supposed to be printed with the particular nozzle becomes blank as shown in FIG. 16B.

Figures 17A, 17B:
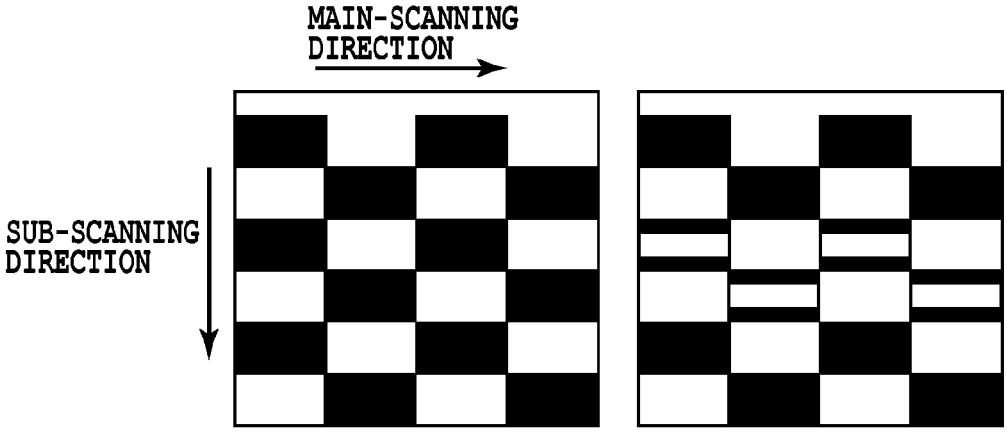
FIGS. 17A and 17B are explanatory diagrams for describing that even when ejection failure in the nozzles used to form the test pattern causes a problem, the test pattern used in the embodiment can alleviate the problem.

To address the problem, the patch element is formed, as shown in FIG. 17A, of plural print blocks also with spaces placed between two adjacent blocks arranged in the main-scanning direction. In addition, the range of used nozzles is dispersed so that the patterns may not be adjacent to each other amongst print blocks. Thus, the negative influence of a particular nozzle on the pattern can be reduced. Specifically, even when there is ejection failure of a particular nozzle, a blank area, the blank area being produced because the patch elements for reference (RPEs) and the patch elements for adjustment (APEs) are not aligned with one another, is reduced (the example in FIG. 17B has half a blank area of that in FIG. 16B). Accordingly, the density of the patch elements, and eventually, that of the patch itself, can be prevented from being lowered. The pattern in FIG. 17B has an area factor (proportion of the area of the patch pattern to the patch area) that is equal to the area factor of the pattern in FIG. 16B. Here, the sum of the density for each unit area within the pattern or the average value thereof is made to be the density value for the entire area of the pattern. Then, the density value becomes the same even when the patterns are different.

Note that in this embodiment, the more the patch element for reference (RPE) and the patch element for adjustment (APE) are laid over each other, the smaller the area factor becomes and the lower the density of the patch thus formed becomes. In another allowable configuration, however, the more the patch element for reference (RPE) and the patch element for adjustment (APE) are laid over each other, the larger the area factor becomes and the higher the density of the patch thus formed becomes. In essence, any configuration is allowable as long as the information on the density can change sensitively in response to the degree of overlaying of, or the degree of offsetting (that is, the conveying error) of, the patch element for reference (RPE) and the patch element for adjustment (APE).

In addition, in this embodiment, each patch element is formed with print blocks arranged in a stair shape. Another arrangement, however, is allowable as long as the print blocks are not continuous in the direction of the scan for printing and as long as the arrangement can effectively reduce the negative influence of the ejection failure. For example, the print blocks may be arranged in a mottled fashion, or at random.

Moreover, in this embodiment, the matte black ink is used to form the test patterns. Any ink of a different color may be used for this purpose as long as the information on density can be acquired with a reading sensor in a favorable manner. In addition, inks of different colors may be used to print the patch elements for reference (RPEs) and to print the patch elements for adjustment (APEs), respectively.

Furthermore, regarding the numbers of the nozzle groups to be used and the positions of the nozzles to be used, the respective examples given in the above embodiment are not the only ones. Any number of nozzle groups and any positions of the nozzles are allowable as long as the change in information on density in response to the conveying error can be acquired in a favorable manner and as long as little negative influence is exerted by an ejection fault of the nozzle. To enhance the accuracy in detection of the conveying error caused by the eccentricity of the roller and by the outer-diameter error, the distance between the nozzle group used to print the patch elements for reference (RPEs) and the nozzle group used to print the patch elements for adjustment (APEs) is preferably made larger, and the two kinds of patch elements preferably have the same pattern.

(6) Correction Value for Conveying Error

In this embodiment, the density of each of the patches constituting the test pattern is measured with the reading sensor 120. In the measurement with the reading sensor 120, the test pattern is scanned with an optical sensor that includes a light emitter and a light detector thereon, and thus the density of each of the patches where the pattern for reference and the pattern for adjustment interfere with each other (FIGS. 15A and 15B) is determined. The density of the patch is detected as the amount of light reflected (intensity of reflected light) when light is emitted onto the patch. The detection operation may be executed only once for each area to be detected, or may be executed plural times to reduce the negative influence of the detection error.

Following the detection of the density of the patches, the densities of the respective plural patches printed in the main-scanning direction are compared with one another. Then, the error in conveying amount is calculated from the positions of, and from the difference in density between, the least dense patch and the second least dense patch. Here, the density values obtained from the least dense patch is denoted with N1, and the density value obtained from the second least dense patch is denoted with N2. Then, the difference in density (N=N2−N1) is compared with three threshold values T1, T2, and T3 (T1<T2<T3). When N<T1, little difference exists between N1 and N2. In this case, the conveying error is determined as the intermediate value of the offset amount for the least dense patch and the offset amount for the second least dense patch (the offset amount for the least dense patch+the length of ½ nozzles). When T1<N<T2, the difference between N1 and N2 is slightly larger than the difference in the previous case. In the case of T1<N<T2, the conveying error is determined as the value that is shifted further from the above-mentioned intermediate value to the side of the least dense patch by an amount of ¼ nozzles (the offset amount for the least dense patch+the length of ¼ nozzles). When T2 N<T3, the difference between N1 and N2 is even larger than the difference in the previous case. In the case of T2<N<T3, the conveying error is determined as the value of the offset amount for the least dense patch+the length of ⅛ nozzles. When T3<N, the difference in density N is significantly large. In this case, the conveying error is defined as the offset amount for the least dense patch.

As has been described above, three threshold values are set in this embodiment, and thus the detection of the conveying error is made possible with a unit of 2.64 μm, which is equivalent to the one eighth of the nozzle pitch, 9600 dpi (=1200×8). The processing is executed for each of the plural—30, to be more specific—patch rows that are formed in the sub-scanning direction. Thus, the conveying error is detected for each circumferential length (2.709 mm×4=10.836 mm) that is used in the four-time actions of conveying the printing medium P for each patch rows.

Figure 19:
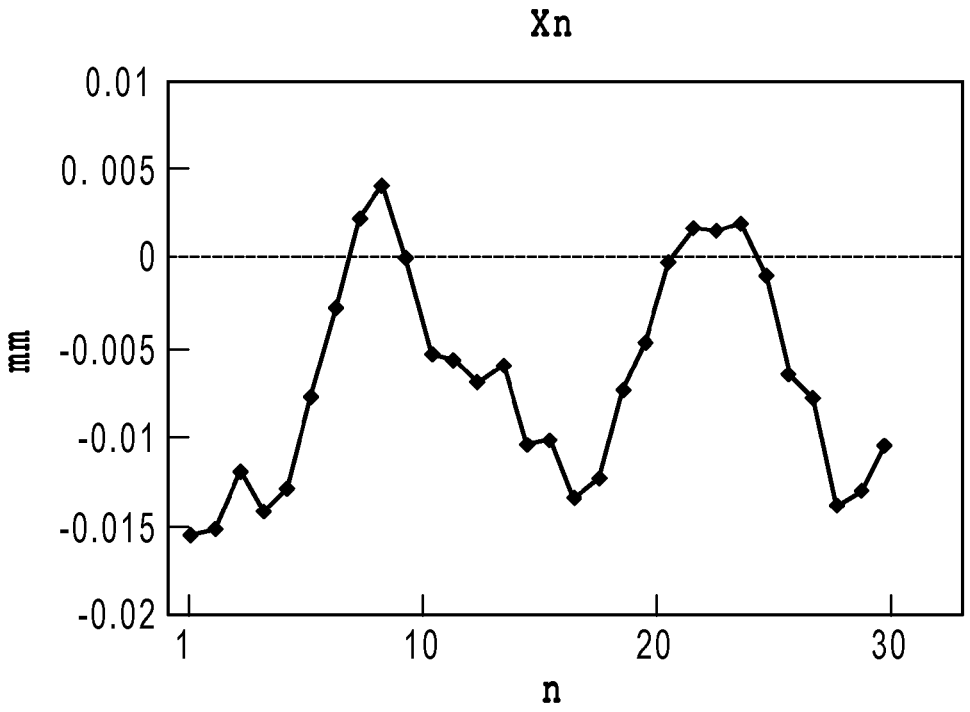
FIG. 19 is an explanatory diagram for illustrating, in a form of a graph, the conveying errors measured in numerical terms based on the information on density obtained from a certain test pattern.

FIG. 19 is a chart illustrating the relationship between the patch rows $B_n$ (n=1 to 30) and the conveying errors $X_n$ detected from the respective patch rows $B_n$. In the chart, the horizontal axis shows the value of n and the vertical axis shows the value of conveying error $X_n$. The plotted values of conveying error $X_n$ correspond to the respective values of n, which in turn correspond to the respective 1 to 30 patch rows $B_n$.

In FIG. 19, the value of the conveying error $X_n$ fluctuates depending upon the values of n. This is because different amounts of conveying are produced by different rotational angles from the reference position of the roller, and this difference in the conveying amount derives from the eccentricity of the roller. Note that the fluctuation of the values of conveying error $X_n$ derives from the eccentricity of the roller so that the fluctuation is a periodic one with a period corresponding exactly to a full rotation of the roller.

In addition, the values of the conveying error $X_n$, as a whole, are shifted either upwards or downwards in response to whether the outer diameter of the roller is larger or smaller than that for reference. When the outer diameter of the roller is larger than that for reference, the printing medium P is conveyed by an amount that is larger than a predetermined amount of conveying. Accordingly, the conveying errors $X_n$, as a whole, are shifted upwards in the chart. In contrast, when the outer diameter of the roller is smaller than that for reference, the conveying errors $X_n$, as a whole, are shifted downwards in the chart.

For the purpose of reducing the values of the conveying error $X_n$, it is necessary to reduce the amplitude, which is the fluctuation component of the conveying errors $X_n$, and to approximate the center value of the fluctuation to zero, that is, to the nominal value of the outer diameter of the roller. To this end, in this embodiment, an appropriate first correction value (correction value for eccentricity) to reduce the amplitude of the conveying errors $X_n$ is acquired, and then a second correction value (correction value for outer-diameter) to approximate the central value of the fluctuation to zero is acquired.

In the following paragraphs, detailed descriptions of the processing to acquire these correction values will be given. The following descriptions will be given by taking the processing for the conveying roller 1 as an example, but similar processing can be carried out for the discharge roller 12. In addition, though the conveying roller 1 conveys the printing medium P in cooperation with the pinch rollers 2 and the conveying error is determined as an outcome of the combination of these rollers, the descriptions that follow are based, for convenience sake, on the assumption that the conveying error is of the conveying roller 1.

(7-1) Acquiring Correction Value for Eccentricity

To begin with, descriptions will be given as to the outline of the conveying control carried out in this embodiment by using the correction value for eccentricity and the correction value for outer-diameter that have been acquired previously. Though the details of this conveying control is to be given later, only the outline thereof will be given beforehand to describe the steps of acquiring the correction value for eccentricity and the correction value for outer-diameter.

Figure 26:
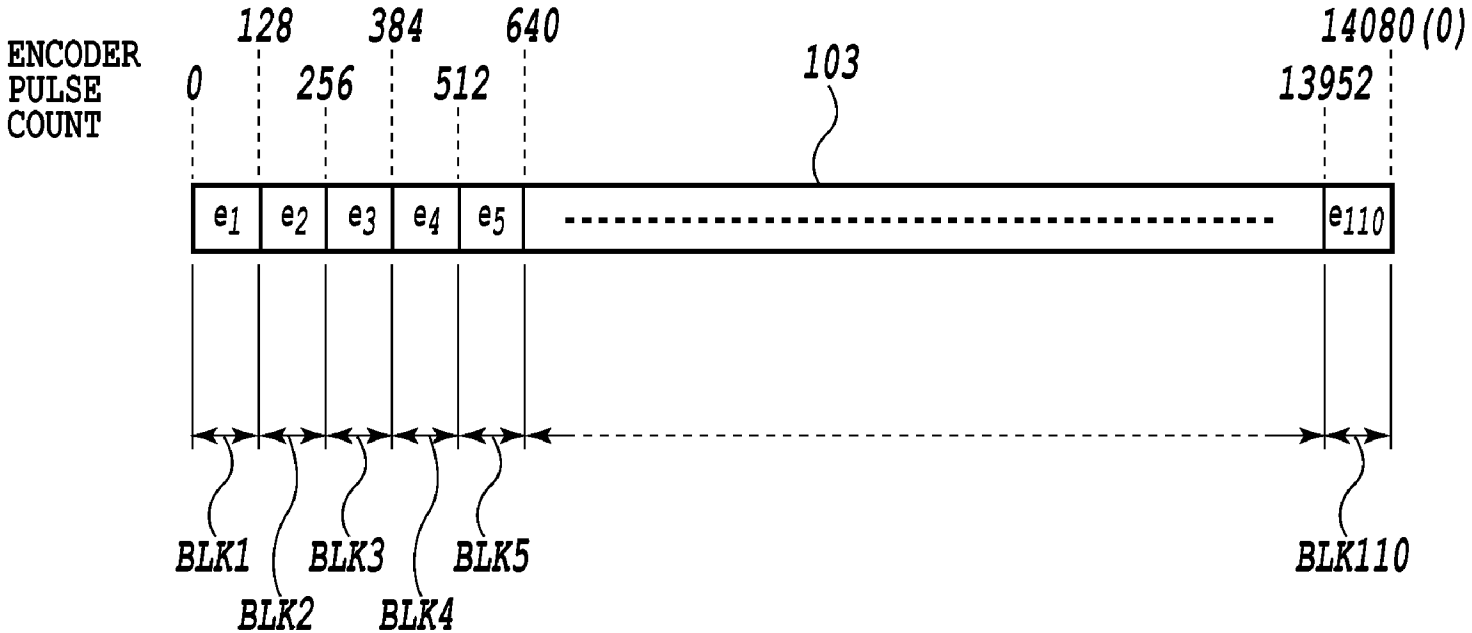
FIG. 26 is an explanatory diagram for describing a way to store a correction value for eccentricity according to the embodiment.
Figure 28:
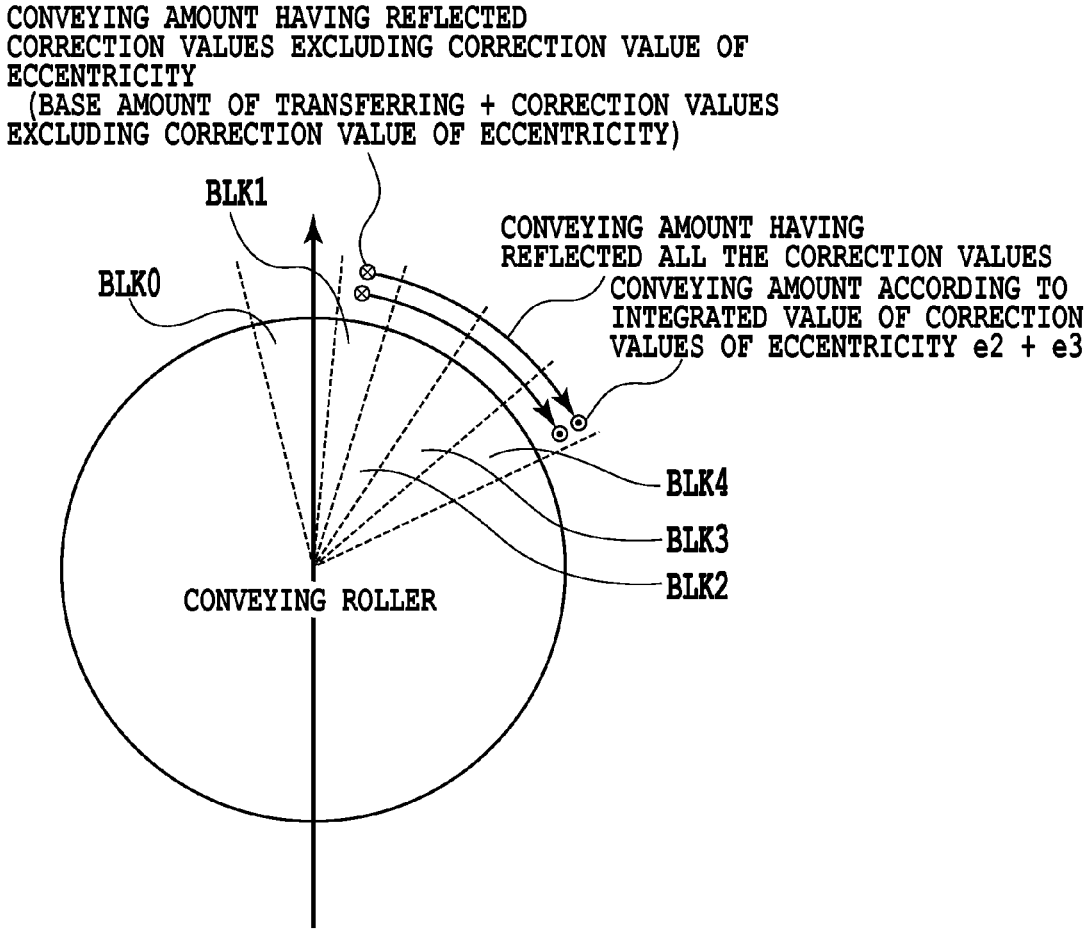
FIG. 28 is an explanatory diagram for describing the way of applying the correction value for eccentricity to the conveying control.

In this embodiment, as shown in FIG. 28, the roller is divided into 110 sectors starting from a position for reference (thus formed are blocks BLK1 to BLK110). Then, a table is prepared to associate the blocks to their respective correction values for eccentricity. FIG. 26 shows an example of such a table. Correction values for eccentricity e1 to e110 are respectively assigned to the block BLK1 to BLK110.

In the conveying control of this embodiment, the base conveying amount is added with a correction value other than the correction value for eccentricity, that is, the correction value for outer-diameter, and then the rotation of the conveying roller 1 is calculated. In other words, from which of the blocks to which of the blocks the conveying roller 1 rotates is calculated. Then, correction value for eccentricity that corresponds to the blocks passing with this rotation is added. The value thus produced is made to be the final conveying amount, and the conveying motor 110 is driven to obtain this conveying amount.

As has just been described, to carry out the conveying control of this embodiment, correction values for eccentricity have to be acquired for each of the blocks created by dividing the circumferential length of the roller in 110 sectors, or, to put it other way, for the blocks each of which has a 0.338-mm (=37.19 mm/110) circumferential length of roller.

In this embodiment, however, the conveying error is detected, from the test pattern, for each circumferential length of roller used to convey the printing medium P four times for each of the patch rows (the length is 10.836 mm). In addition, two adjacent patch rows in the test pattern share part of their respective roller sectors used to carry out their respective four-time actions of conveying the printing medium P. So, following the procedures to be described below, correction values for eccentricity are acquired from the test pattern for the respective blocks of the roller, each of which blocks has a circumferential length (0.338 mm) formed by dividing the circumferential length of the roller into 110 sectors.

Incidentally, the period of the eccentricity appears in the form of a periodic function with period equivalent to the circumferential length of the roller. So, a periodic function having a periodic component that is equivalent to the circumferential length of the roller and having a polarity that is opposite to that of the function of the conveying error is to be obtained firstly in this embodiment (hereafter, such a function will be referred to as "correction function"). Then, the distance from the reference position of the roller is assigned to the correction function. Accordingly, the correction value for eccentricity is acquired for each of the blocks formed by the division into 110 sectors.

The correction function in this embodiment is obtained by selecting a combination of an amplitude A and an initial phase θ that are capable of reducing most the conveying error caused by the eccentricity of the roller—that is, the amplitude component of the conveying error $X_n$ shown in FIG. 19—for a sine function, $y=A\sin(2\pi/L\times T+\theta)$. Here, L is the circumferential length of the roller (specifically, 37.19 mm for the conveying roller 1), and T is the distance from the reference position of the roller. Four different values—specifically, 0, 0.0001, 0.0002, and 0.0003—can be set for the amplitude A, while 22 different values—specifically, $-5m\times 2\pi/110$ (m=0, 1, 2, 3, . . . , 21)—can be set for the initial phase θ. In summary, 66 different combinations of the amplitude and the initial phase without including the case of the amplitude A=0 are selectable in this embodiment, and 67 different combinations are selectable when the case of the amplitude A=0 is included. Amongst these different combinations, an optimum combination of the amplitude A and the initial phase θ for correcting the eccentricity of the roller is selected.

Figure 18:
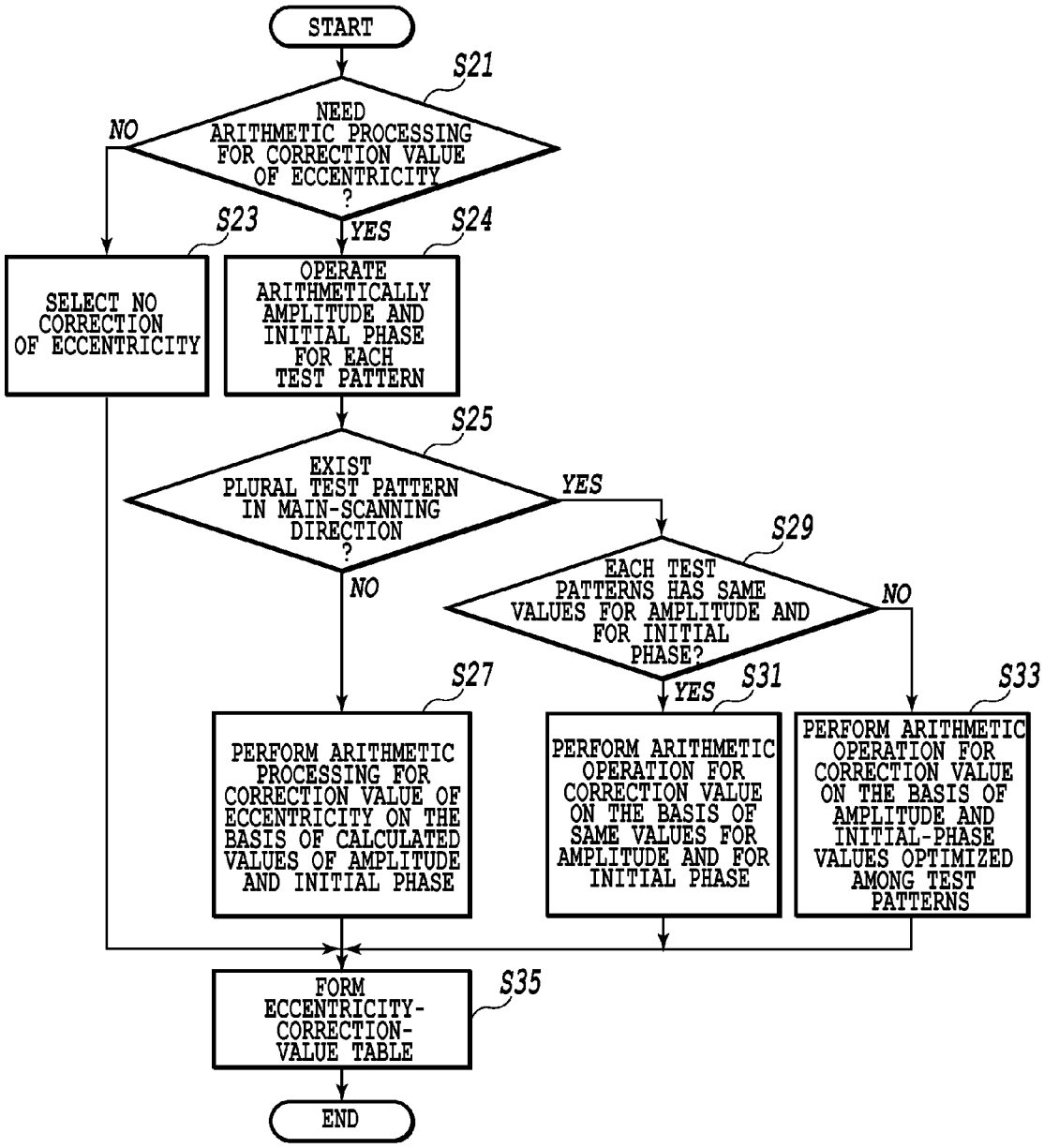
FIG. 18 is a flowchart illustrating an example of arithmetic processing procedure to find the correction value for eccentricity according to the embodiment.

FIG. 18 illustrates an example of arithmetic processing procedure for finding the correction value for eccentricity.

Firstly, in step S21, a determination is made to judge whether an arithmetic processing is necessary to acquire the correction value for eccentricity, and this determination has to precede the acquirement of the correction value for eccentricity from the correction function. For example, when the conveying error caused by the eccentricity is smaller than a certain threshold value, such arithmetic processing to acquire the correction value for eccentricity is judged to be unnecessary. If this is the case, the amplitude of the correction function is set at zero, and the procedure is finished. In the embodiment, the procedure for determining the necessity of the arithmetic processing to acquire the correction value for eccentricity will be given in the following paragraphs.

Figure 20:
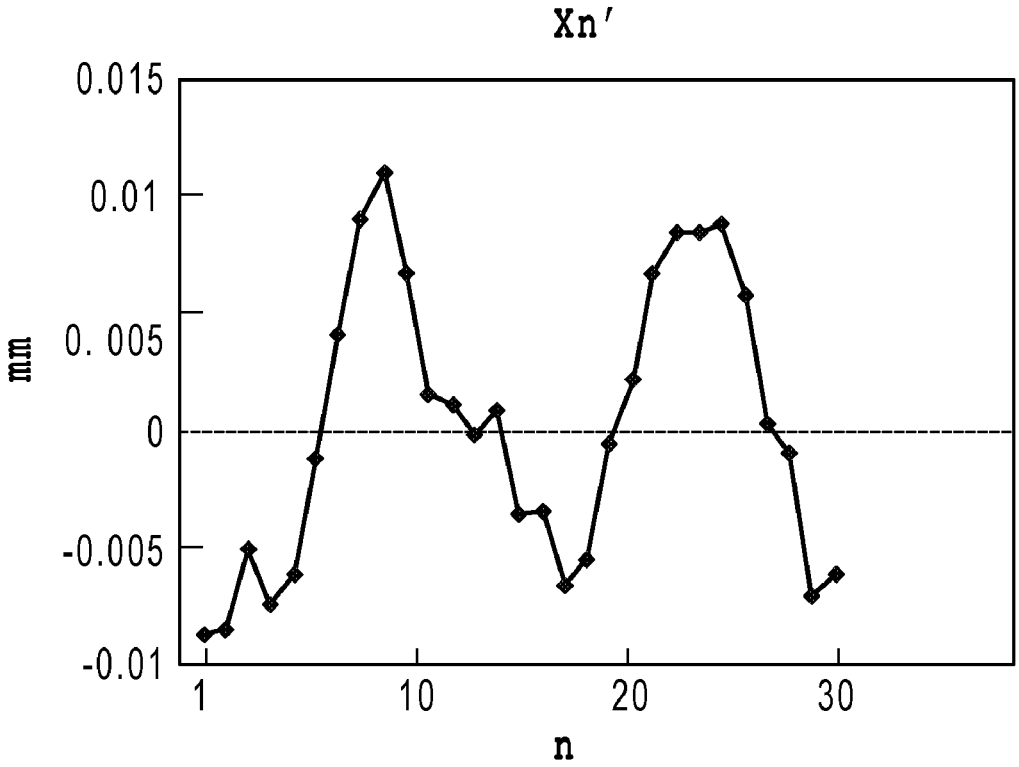
FIG. 20 is an explanatory diagram for showing the difference that the conveying error for each value of n has with their average value.

Firstly, the average value $X_n$(ave) of the conveying errors $X_n$ (n=1 to 30) shown in FIG. 19 is obtained, and the differences $X_n'$ between this average value $X_n$(ave) and the conveying errors $X_n$ are calculated. FIG. 20 is a chart illustrating the relationship between the value of n and the difference $X_n'$ with the values of n on the horizontal axis and with the differences $X_n''$ on the vertical axis. Then, the absolute value $|X_n'|$ of each of the differences $X_n''$ is squared, and the sum of this squared values $\Sigma|X_n'|^2$ is calculated. When the sum $\Sigma|X_n'|^2$ thus calculated is smaller than the certain threshold value mentioned above, a determination that the correction value for eccentricity is unnecessary is made.

In contrast, when the sum $\Sigma|X_n'|^2$ thus calculated is larger than the certain threshold value mentioned above, the operational flow advances to the processing to acquire the correction function to correct the eccentricity of the roller. In a step S24, a correction function having an amplitude A and an initial phase θ that are optimum to correct the eccentricity of the roller is calculated. An example of the way to calculate this correction value will be given in the following paragraphs.

Firstly, for each of all the combinations (66 combinations without the case of the amplitude A=0) of the amplitude A and the initial phase θ in the above-described sine function, the values are obtained by assigning, to the variable T of the sine function, the 34 different values starting from 2.709 to 92.117 at the intervals of 2.709.

For example, values $y_1$, $y_2$, and $y_3$ are obtained respectively by assigning 2.709, 5.418, and 8.128 to the variable T of the above-mentioned sine function with a certain amplitude A and a certain initial phase θ. The calculation continues until a value y34 is obtained by assigning 92.117 to the variable T. The processing has to be done for all the 66 different combinations of the amplitude A and the initial phase θ without the case of the amplitude A=0.

Then, four successive values of y in a certain combination of the amplitude A and the initial phase θ are added together to produce 30 integrated values $Y_n'$. For example, $y_1'=y_1+y_2+y_3+y_4$, and $y_2'=y_2+y_3+y_4+y_5$. In this way, values from $y_1'$ to $y_{30}'$ are calculated. The processing has to be done for all the 66 different combinations of the amplitude A and the initial phase θ.

Note that the values $y_1$, $y_2$, $y_3$, and $y_4$ are obtained by assigning, respectively, 2.709, 5.418, 8.128, and 10.836 to the variable T, where T is the distance from the reference position of the roller. Accordingly, in the sine function having a certain combination of the amplitude A and the initial phase θ, the value $y_1'$ obtained by adding the values $y_1$ to $y_4$ together is a value that corresponds to a sector of the roller starting from the reference position and ending with the 10.836-mm position. Likewise, in the sine function having a certain combination of the amplitude A and the initial phase θ, the value $y_2'$ obtained by adding the values $y_2$ to $y_5$ together is a value that corresponds to a sector starting from the 2.709-mm position and ending with the 13.545-mm position.

Figure 21:
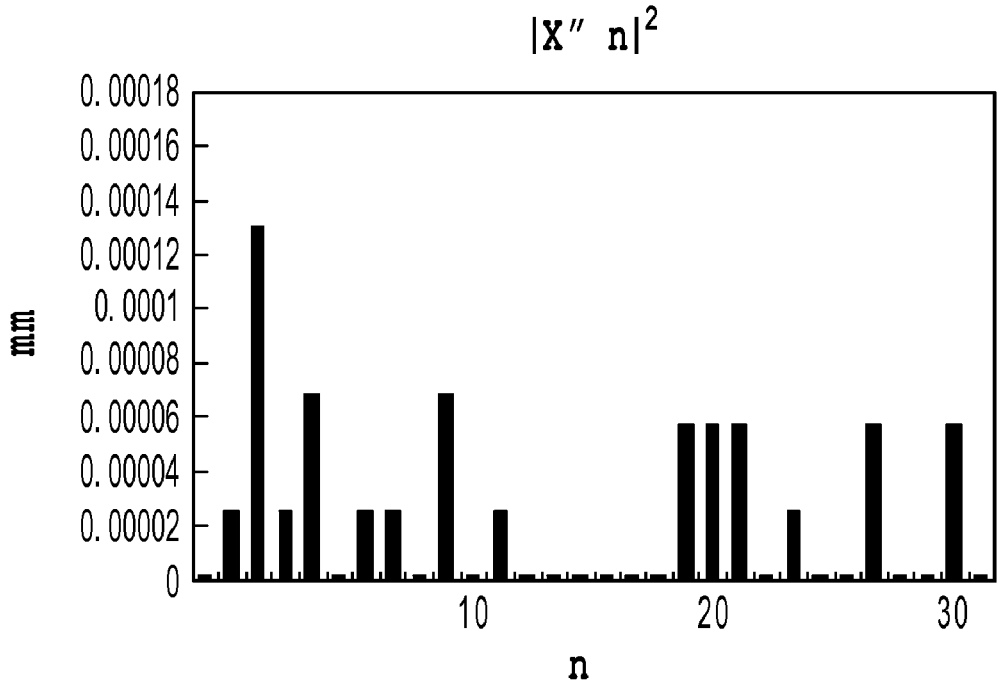
FIG. 21 is an explanatory diagram for showing the absolute values of addition values $X_n''$ for each value of n.

Subsequently, for each of the combinations of the amplitude A and the initial phase θ, the integrated values $y_n'$ are added to the respective differences $X_n'$ between the conveying errors $X_n$ and the average value. For example, $y_1'$ is added to $x_1'$, and $y_2'$ is added to $X_2'$. The following additions are carried out similarly until $y_{30}'$ is added to $X_{30}'$. Thus obtained are addition values $X_n''$. Then, the absolute value of each of the addition values $X_n''$ is squared, and the sum of this squared values $\Sigma|X_n''|^2$ is calculated. FIG. 21 shows a graph illustrating the relationship between the value of n and the squared absolute value $|X_n''|^2$ of the addition values while the values of n are on the horizontal axis and the values of $|X_n''|^2$ are on the vertical axis. By summing up the squared absolute values $|X_n|^2$ corresponding to the respective values of n in this graph, the sum of the $\Sigma|X_x''|^2$ of the addition values Xn squared can be calculated.

In accordance with a procedure that is similar to the one described above, the sum $\Sigma|X_n''^2|$ of the squared absolute value of the addition values Xn is obtained for each of the all the 66 different combinations of the amplitude A and the initial phase θ. Then, one of the 66 combinations is selected so as to minimize the value of the square sum $\Sigma|X_n''|^2$. What can be obtained in this way is a correction function that can reduce most the conveying error caused by the eccentricity of the roller, that is, the amplitude component of the conveying error $X_n$. After that, the correction value for eccentricity for each block formed by dividing the roller into 110 sectors can be acquired by assigning the distance from the reference position for each of the blocks to the variable T of the correction function.

According to the above-described method of acquiring the correction value for eccentricity, the correction value for eccentricity for an area of the roller that is associated with the distance from the reference position of the roller can be obtained even with a test pattern, such as the one of this embodiment, in which:

the conveying error $X_n$ detected from each of the patch rows corresponds to a circumferential length of the roller corresponding to plural times of the conveying action for the printing medium P; and two adjacent patch rows share part of the sectors of the roller that are used to print the respective patch elements for reference and to print the respective patch elements for adjustment.

Subsequently, in step S25 in FIG. 18, a determination is made to judge whether there are plural test patterns in the main-scanning direction.

When only a single test pattern is printed in the main-scanning direction, a correction function is determined on the basis of the information on the density obtained from the test pattern so as to have an optimum combination of the amplitude A and the initial phase θ to correct the eccentricity. Then the correction value is arithmetically operated using the correction function (step S27).

Even for a roller manufactured within a predetermined design tolerance, the conveying error that derives from the amount and the state of eccentricity of the roller may sometimes vary between on the conveying-reference side and on the non-conveying-reference side of the printing apparatus. To address this phenomenon, two test patterns can be printed in the main-scanning direction in this embodiment. Accordingly, for each of the patterns, an optimum combination of the amplitude A and the initial phase θ to correct the eccentricity is obtained. Then, in step S29, the two combinations thus obtained are compared to determine whether the two combinations are the same or different. When the two combinations are the same, the correction value is arithmetically operated on the basis of the correction function with the common amplitude A and the common initial phase θ (step S31).

In contrast, there may be cases where the combination of the amplitude A and the initial phase θ on the conveying-reference side is different from the combination thereof on the non-conveying-reference side. In this case, selected is the combination of the amplitude A and the initial phase θ that minimizes the larger one of the values of square sum $\Sigma|X_n''|^2$ for the conveying-reference side and the non-conveying-reference side. The reason why such a way of selection is employed is avoiding the following inconvenience. It is possible to select the combination of the amplitude A and the initial phase θ that minimizes the smaller one of the values of square sum $\Sigma|X_n''|^2$ for the conveying-reference side and the non-conveying-reference side. Such selection may cause an unfavorable situation in which the conveying error caused by the eccentricity of the roller cannot be limited within the range of the design tolerance. When the combination of the amplitude A and the initial phase θ on the conveying-reference side is different from the combination thereof on the non-conveying-reference side, the processing described in the following paragraphs is carried out.

Firstly, for each of the three amplitude conditions (specifically, A=0.0001, A=0.0002, and A=0.0003), the square sum $\Sigma|X_n''|^2$ are plotted while the initial phase θ is changed. The plotting is done both for the conveying-reference side and for the non-conveying-reference side. The two curves thus obtained and representing the respective sides are compared with each other. From the two curves, sections of one of the two curves that have larger values than the values of the corresponding section of the counterpart curve are selected. The operation is schematically illustrated in FIGS. 22A and 22B.

Figure 22A:
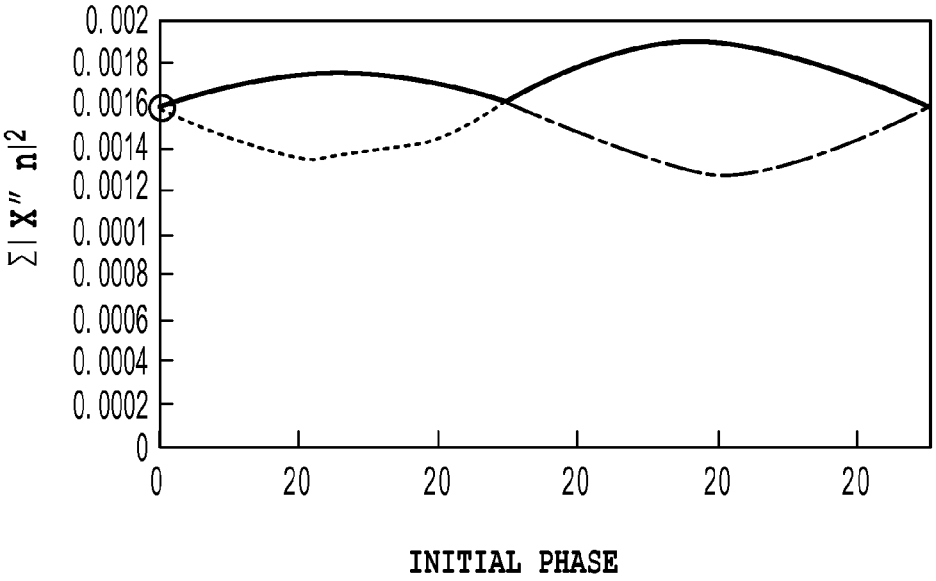
FIGS. 22A and 22B are explanatory diagrams for showing two examples of processing carried out to obtain a final correction value for eccentricity when plural test patterns are formed in the main-scanning direction.
Figure 22B:
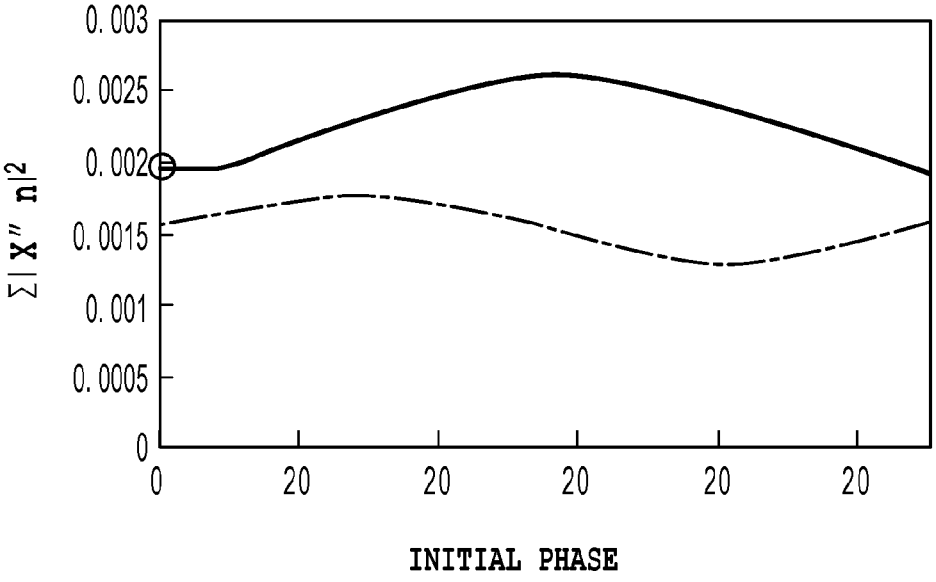

FIGS. 22A and 22B illustrate the curves each of which obtained by plotting the square sum $\Sigma|X_n''|^2$ with the initial phase θ varying for each of the side near the conveying-reference and the side far from the conveying-reference. FIG. 22A is of a case where the curve for the conveying-reference side crosses the curve for the non-conveying-reference side. In this case, the sections represented by a thick solid line are the sections where the values of the square sum $\Sigma|X_n''|^2$ on the curve are larger than the corresponding values on the counterpart curve. FIG. 22B, on the other hand, illustrates a case where the curve for the conveying-reference side does not cross the curve for the non-conveying-reference side. In this case, the whole sector of one of the two curves constantly has the larger values of the square sum $\Sigma|X_n''|^2$, and is accordingly shown by a thick solid line in FIG. 22B.

Subsequently, within the selected sector, or sectors, having larger values of the square sum $\Sigma|X_n''|^2$ (shown by the thick solid line in FIGS. 22A and 22B), the value of the initial phase θ that makes the value of the square sum $\Sigma|X_n''|^2$ the lowest is selected as the optimum value under the amplitude condition of the case. When the two curves cross each other as shown in FIG. 22, one of the intersecting points that has the lowest value of the square sum $\Sigma|X_n''|^2$ is selected as the optimum value under the amplitude condition of the case. In the case shown in FIG. 22B, the value of the initial phase at the lowest-value point on the thick solid line is selected as the optimum value under the amplitude condition of the case.

The operation described above is carried out for each of the amplitude conditions. Then, the values of the square sum $\Sigma|X_n''|^2$ corresponding to the respective initial values determined individually for the amplitude conditions are compared with one another. Thereafter, the amplitude A and the initial phase θ of a case where the value of the square sum $\Sigma|X_n''|^2$ is the lowest are selected as the optimum values. After that, the correction value is arithmetically operated on the basis of the correction function having the optimum amplitude A and the optimum initial phase θ (step S33).

As has been described thus far, in this embodiment, the optimum values of the amplitude A and of the initial phase θ are obtained from a single test pattern or plural test patterns and then a correction function having such optimum values is determined. Then, on the basis of this correction function, the correction value for eccentricity is acquired.

In the above description, the correction value for eccentricity for each of the sectors formed by dividing the roller into 110 parts (blocks BLK1 to BLK110) is acquired while the correction values for eccentricity are associated with the respective distances from the reference position of the roller to the respective sectors. Note that this is not the only way to acquire the correction values for eccentricity. For example, the correction values for eccentricity may be acquired while the correction values for eccentricity are associated with the respective rotational angles from the reference position of the roller to the respective sectors.

In this embodiment, the rotary encoder 116 attached to the conveying roller 1 outputs 14080 pulses per rotation, for example. Then, the 14080 pulses are divided into groups each of which has 128 pulses so as to suit for the 110 sectors. Thus, the current position of the roller can be detected in accordance with the pulses outputted from the rotary encoder 116. Then, for each of the 110 sectors (blocks), the correction value for eccentricity is associated with the rotational angle from the reference position of the roller. Subsequently, an eccentricity-correction-value table is formed by setting these correction values for eccentricity (step S35) in the table. Storing these set values in, for example, the EEPROM 103 (see FIG. 3), makes it possible to keep these values even when the apparatus itself is switched off. Updating the set values is also made possible according to this configuration.

(7-2) Acquiring Correction Value for Outer-Diameter

Besides the reduction of the conveying error caused by the eccentricity of the roller, the reduction of the conveying error caused by the outer-diameter error of the roller is effective for reducing the conveying error in total. The latter processing is the outer-diameter correction. Hereafter, descriptions will be given as to the way of acquiring the correction value for outer-diameter to use that processing and as to the reason why the acquiring of the correction value for eccentricity has to precede the processing for acquiring the correction value for outer-diameter.

Figure 23:
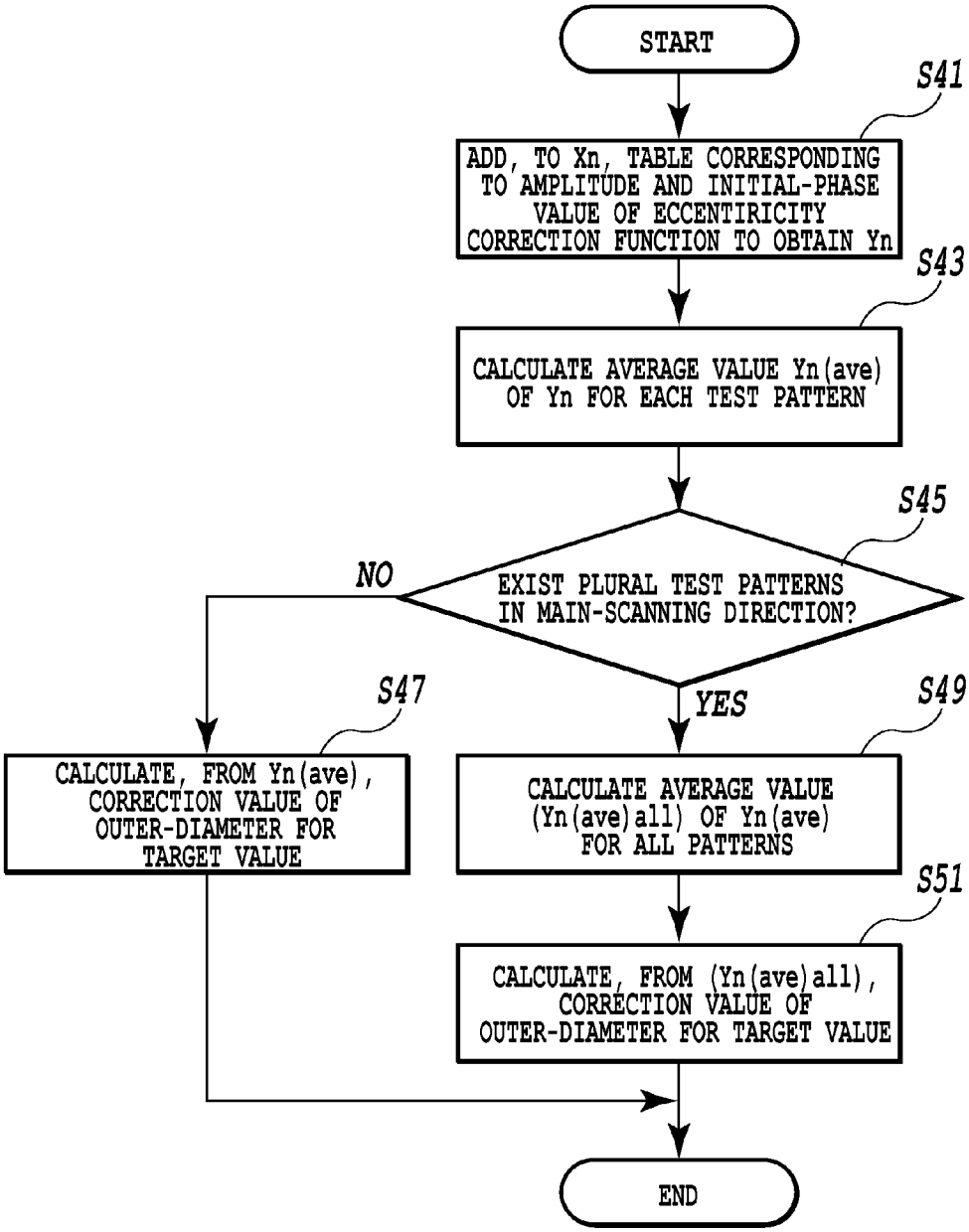
FIG. 23 is a flowchart illustrating an example of arithmetic processing procedure to acquire a correction value for outer-diameter according to the embodiment.

FIG. 23 illustrates an example of arithmetic processing procedure to acquire the correction value for outer-diameter.

Firstly, contents of the eccentricity-correction-value table are applied to the conveying errors $X_n$ detected from the respective patch rows of the test patterns, and the values thus obtained are denoted as $Y_n$ (step S41). Then, the average value of $Y_n$ are calculated and denoted as $Y_n$(ave) (step S43). Note that, as has been described above, each of the conveying errors $X_n$ is the conveying error for the circumferential length of the roller corresponding to the four-time conveying of the printing medium P. Accordingly, before being applied to the conveying errors, the correction values for eccentricity in the eccentricity-correction-value table have to be integrated so as to be suitable for the conveying errors $X_n$ thus obtained.

Subsequently, a determination is made to judge whether there are plural test patterns in the main-scanning direction (step S45). When there is only a single test pattern printed in the main-scanning direction, the difference between a target value (the value of the roller with dimensions that are exactly equal to the nominal ones and, accordingly, without any conveying error) and the average value $Y_n$(ave) are calculated. Then, on the basis of the calculated differences, the correction value for outer-diameter is determined (step S47).

Here, when the difference obtained by subtracting the average value $Y_n$(ave) from the target value is positive, the roller has a circumferential length that is longer than the roller with dimensions equal to exactly nominal ones. To put it other way, even a single conveying action using the roller conveys the printing medium P more than the amount that is supposed to be conveyed. Accordingly, in this case, a correction value (correction values for outer-diameter) is determined in step S47 so as to make the average value $Y_n$(ave) equal to the target value.

On the other hand, when plural test patterns (two test patterns in this embodiment) are printed in the main-scanning direction, the average values $Y_n$(ave) obtained from the respective test patterns are added up to find the average value thereof (step S49). The difference between this average value thus obtained and the target value is used to produce determine the correction values for outer-diameter (step S51). This correction value for outer-diameter can also be stored in the EEPROM 103 (see FIG. 3).

Now, description will be given in the following paragraphs as to the reason why the acquiring of the correction values for eccentricity has to precede the acquiring of the correction values for outer-diameter.

In this embodiment, emphasis is put on the achievement of a high-accuracy conveying-error correction without sacrificing the versatility of the test pattern and of the printing method. Assume that a test pattern used here has a length in the sub-scanning direction that is equal to an integral multiplication of the circumferential length of the roller. With such a test pattern, acquiring high-accuracy conveying-error correction values is possible even when the order of the acquiring of the correction values for eccentricity and the acquiring of the correction values for outer-diameter is reversed.

The test pattern used in this embodiment, however, has an 80-mm length in the sub-scanning direction. When a roller with a nominal outer circumference of 37.19 mm is used, the 80-mm length exceeds an integral multiplication of the roller with the nominal outer circumference (exceeds the amount of two full rotations of the roller). Hence, in this embodiment, the conveying error is detected from the area, within the test pattern, corresponding to the two full rotations of the conveying roller and detected from the excess area corresponding to a small, beginning part of the third rotation.

Note that it is, in fact, difficult to form a test pattern with its length in the sub-scanning direction that is precisely equal to an integral multiplication of the circumferential length of the roller. In addition, the tolerance of the outer diameter of the conveying roller 1 may sometimes cause fluctuations in the period of the eccentricity of the conveying roller 1. It is, therefore, rather preferable that the test pattern have a larger length in the sub-scanning direction than an integral multiplication of the nominal circumferential length of the conveying roller 1. Nevertheless, when the test pattern has a length in the sub-scanning direction that is not equal to an integral multiplication of the circumferential length of the roller, or to put it other way, when the conveying error is detected from the test pattern including an excess area, such inconveniences as described in the following paragraph may possibly occur.

Figure 24:
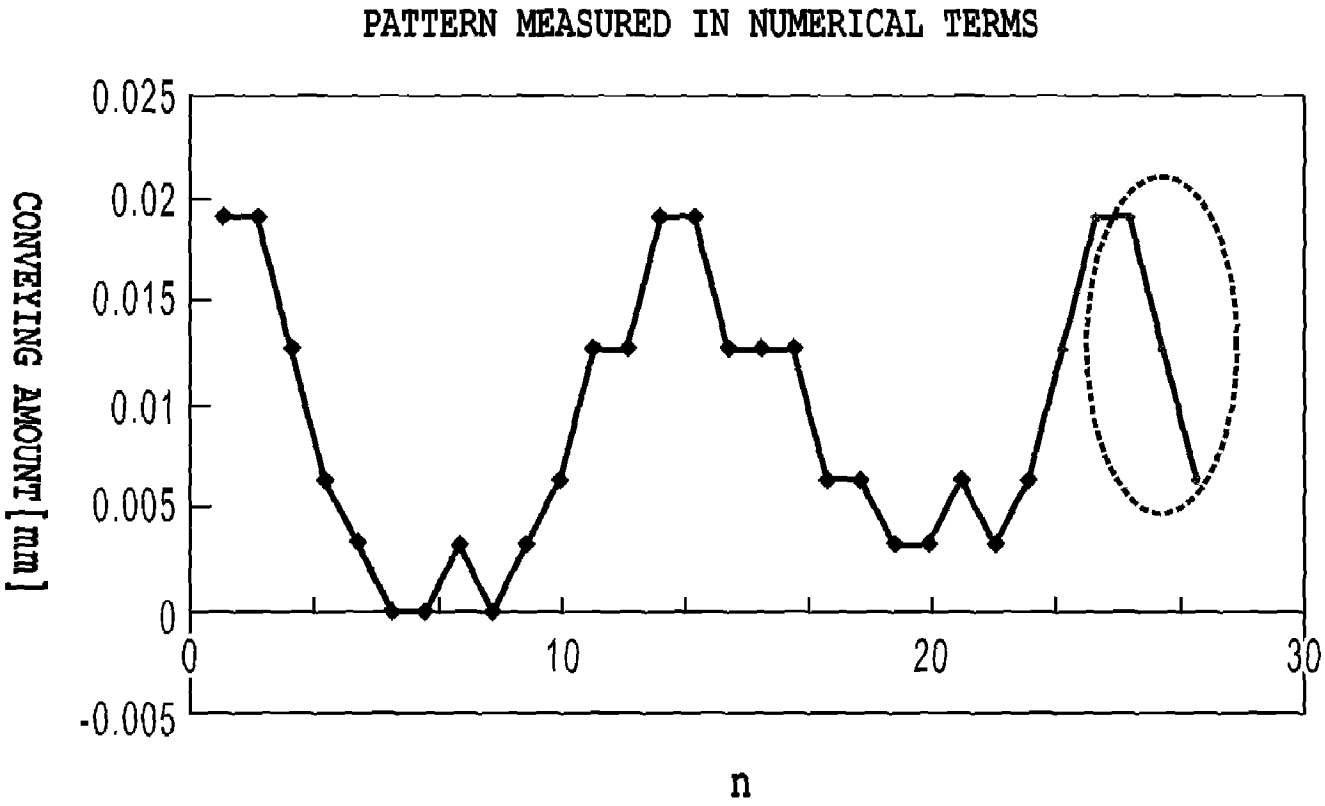
FIG. 24 is an explanatory diagram for describing the occurrence of an error in the correction value for outer-diameter.

In FIG. 24, conveying errors ($X_n$) acquired from the test pattern in this embodiment are plotted. The area marked by a circle in FIG. 24 corresponds to the excess area. As has been described before, the correction value for outer-diameter is used to correct the amount of the conveying error for each rotation of the conveying roller 1, and is calculated by the average of the values of the conveying error. Acquiring a precise correction value for outer-diameter, however, is problematic when the eccentricity of the roller causes significantly large deviation, from the average value, of the conveying error for the excess area.

In this embodiment, to reduce the negative influence caused by the part of the excess area, the correction value for eccentricity is acquired. Then, after the correction value for eccentricity is applied, the arithmetic processing of the correction value for outer-diameter is carried out. Accordingly, a variation in conveying error in the excess area is suppressed. As a result, it is possible to reduce a difference between the conveying error and the average of the values of the conveying error, so that the influence of the eccentricity can be reduced.

FIG. 25 shows examples of correction values acquired through the processing, firstly, of the correction value for eccentricity and then through the processing of the correction value for outer-diameter as well as examples of correction values acquired through the two processing carried out in the reverse order. Here, for the sake of simplicity, outcomes of calculation on the test pattern FR1 on the conveying-reference side are compared.

Firstly, assume that the correction values are calculated in an order in which the processing for the correction value for outer-diameter precedes the processing for the correction value for eccentricity. In this case, when the average value Yn(ave) is calculated in a state shown in FIG. 24, the value becomes 9.31 μm. After the correction value for outer-diameter acquired on the basis of this value of 9.31 μm is reflected, an operation of eccentricity correction is carried out. In this case, a value of 0.0003 is selected for the amplitude A. Meanwhile, a value of n=13 is selected for the initial phase θ. In contrast, assume that the calculation of the correction value for eccentricity precedes the calculation of the correction values for outer-diameter, as in the case of this embodiment. In this case, a value of 0.0003 is selected for the amplitude A. Meanwhile, a value of n=13 is selected for the initial phase θ. Then, while the correction value for eccentricity is applied, the value of Yn(ave) is calculated. The resultant value becomes 8.74 μm (on the basis of this value $Y_n$(ave) of 8.74 μm, the correction value for outer-diameter is acquired). The comparison of the procedures in different orders makes it clear that the correction values for eccentricity are the same but that the correction values for outer-diameter are different from each other.

Note that, here, the theoretical figure of the correction value for outer-diameter is 8.54 μm when the correction value for outer-diameter is calculated by extracting the value of Xn corresponding to two full rotations of the roller from the state in FIG. 24. Accordingly, as in the case of this embodiment, when the acquiring of the correction value for eccentricity precedes the acquiring of the correction values for outer-diameter, the correction value for outer-diameter can be acquired with the deviations from the theoretical figure being made smaller.

(8) Control of Conveying

As has been described above, in this embodiment, the rotary encoder 116 attached to the conveying roller 1 outputs 14080 pulses for each rotation. Then, in this embodiment, the 14080 pulses are divided into 110 circumferential sectors each of which has 128 pulses starting from the reference position of the rotary encoder 116. Subsequently, a table for storing the correction values for eccentricity acquired through the arithmetic processing for correction values for eccentricity is formed so as to make the correction values for eccentricity correspond to the respective above-mentioned circumferential sectors.

FIG. 26 shows an example of the table thus formed. Correction values for eccentricity e1 to e110 are allocated so as to correspond to the respective blocks BLK1 to BLK110 each of which has a rotational angle corresponding to 128 pulses of the rotary encoder 116. These correction values for eccentricity are reflected in the control of the conveying in a way described in the following paragraphs.

Figure 27:
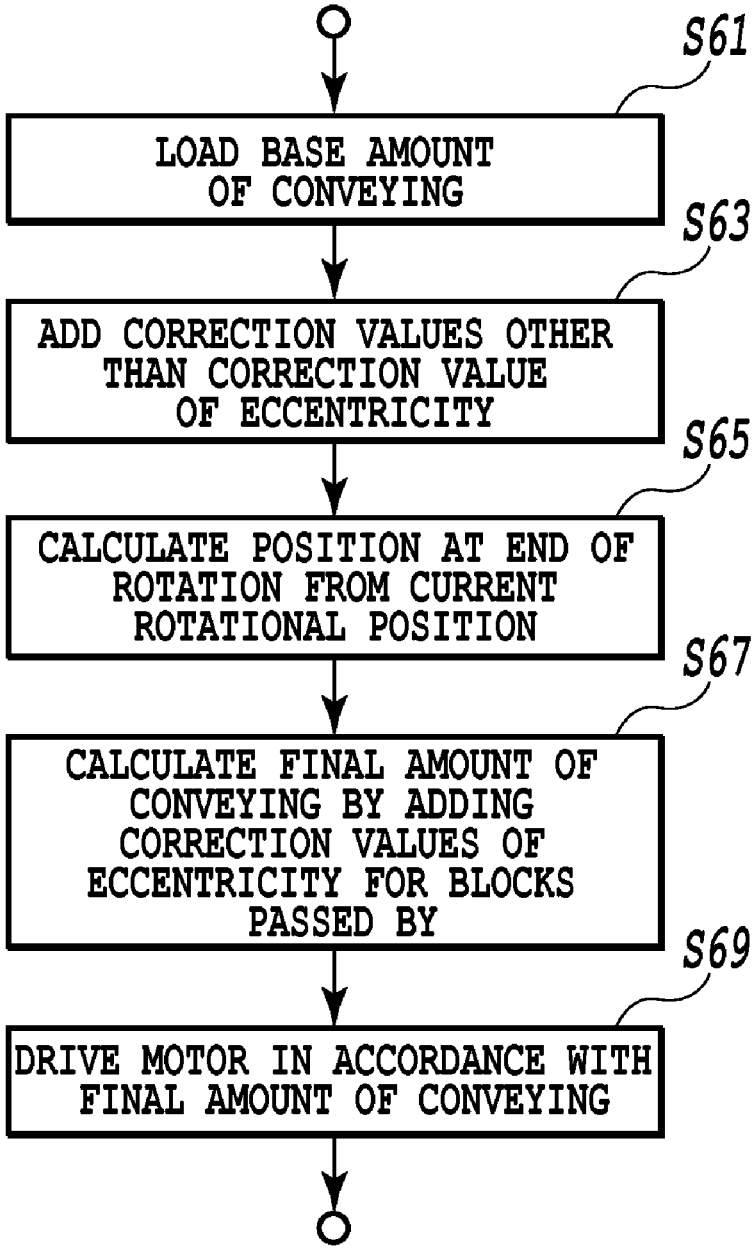
FIG. 27 is a flowchart showing an example of the conveying control procedure according to the embodiment.

FIG. 27 shows an example of the procedure for the control of the conveying. FIG. 28 is an explanatory diagram for describing the operation corresponding to this procedure. Note that the procedure shown in FIG. 27 is executed for the purpose of determining the amount of conveying the printing medium P (sub scan) between every two printing scans, and can, accordingly, be done either during a printing scan or after the completion of a printing scan.

Firstly, in a step S61, the base amount of conveying is loaded. The base amount of conveying is a theoretical value of the sub-scanning amount between every two consecutive printing scans. Then, in a step S63, the base amount of conveying is added with a correction value other than the correction value for eccentricity, that is, the correction value for outer-diameter. Moreover, in a step S65, a calculation is executed so as to find to what position the conveying roller 1 rotates from the current rotational position in response to the resultant value of the above-mentioned addition. In the example shown in FIG. 28, the conveying roller 1 rotates from a position within the block BLK1 to a position within the block BLK4.

After that, in a step S67, the correction values for eccentricity corresponding to the blocks that are passed by during the rotation of this time are added. To be more specific, in the example shown in FIG. 28, the blocks BLK2 and BLK3 are passed by during the rotation, so that the correction values for eccentricity e2 and e3 are added. The resultant value from the addition is made to be the final amount of conveying, and then the conveying motor 110 is driven to obtain this amount of conveying (step S69).

Note that only the correction values for eccentricity for the blocks that are passed by are configured to be added in this embodiment, but another configuration is possible. In accordance with the position within the current block before the rotation (i.e. block BLK1) and the position within the block after the rotation (i.e. block BLK4), the correction values for eccentricity for these blocks are converted appropriately, and the values thus converted can be used for the addition. Nevertheless, the simple use of the correction values of the respective blocks that are passed by can be processed with more ease and in shorter time than such a fine-tune recalculation of the correction value can.

The correction values thus far described are those for the conveying roller 1, but the correction values for the discharge roller 12 can be obtained in a similar way and can be stored in the EEPROM 103. The stored correction value for the discharge roller 12 can be used when the roller, or rollers, used for the conveying is switched to the discharge roller 12 alone.

(9) Ways of Acquiring Correction Values

The correction value for eccentricity and the correction value for outer-diameter may be acquired on the basis of the information on density obtained by scanning the test pattern with a reading sensor 120 mounted, along with the print head 4, on the carriage 7. Alternatively, the correction value for eccentricity and the correction value for outer-diameter may be acquired on the basis of the information on density obtained by scanning the test pattern with a reading sensor 120 provided in the form of a reading head and mounted, in place of the print head 4, on the carriage 7.

Figure 29:
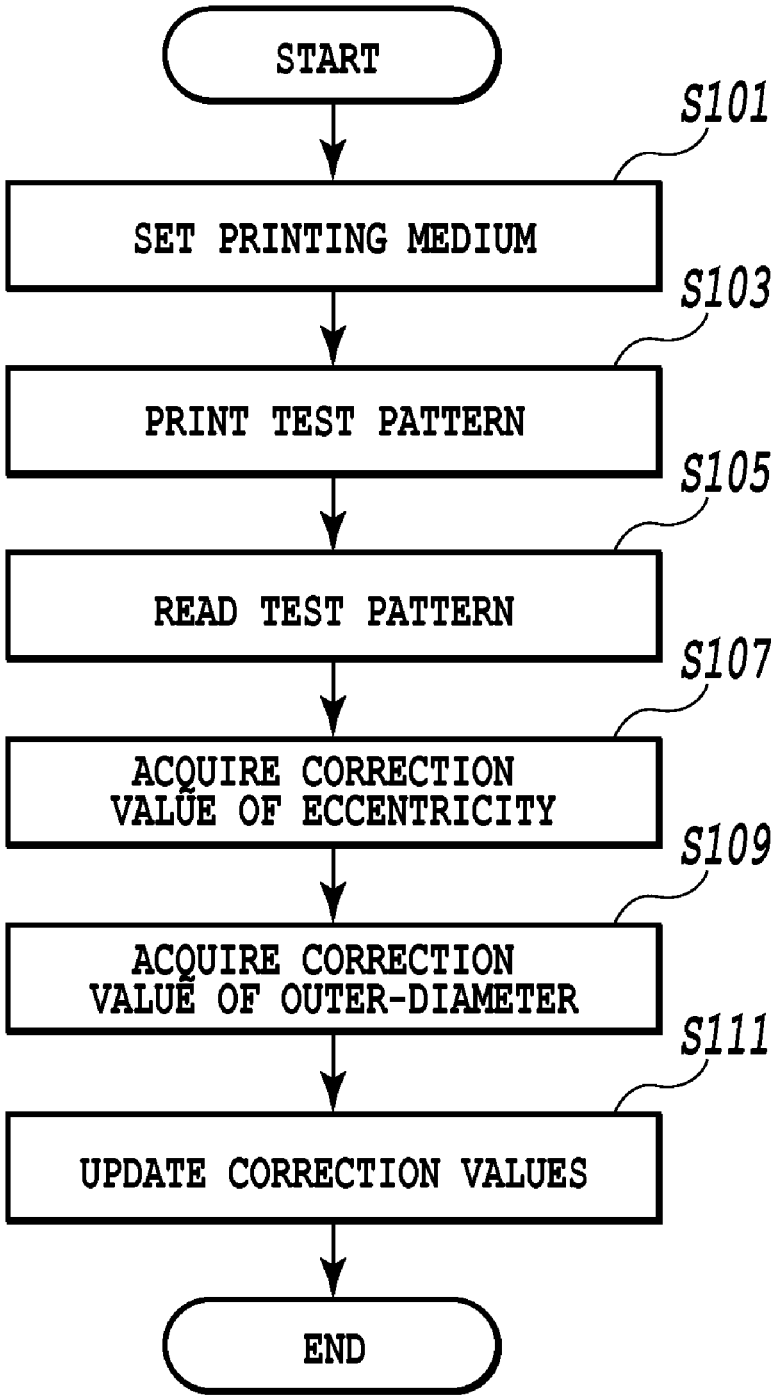
FIG. 29 is a flowchart showing an embodiment of the processing procedure from the formation of a test pattern to the storing of a conveying-error correction value.

FIG. 29 shows an example of the processing procedure corresponding to the configurations described above. At the start of this procedure, the printing medium P is set (step S101), and test patterns such as ones shown in FIG. 5 are printed (step S103). Then, the printing medium P with the test patterns formed thereon is set in the apparatus again, and the operation of reading the test patterns is executed to acquire the information on density (step S105). After that, on the basis of the information on density, the correction value for eccentricity and the correction value for outer-diameter are acquired in this order (steps S107 and S109), and then these correction values are stored (or updated) in the EEPROM 103 (step S111).

In a case where the printing apparatus has no built-in reading sensor (including a case where the printing apparatus are configured as a multi-function apparatus having a scanner apparatus unit integrated therewith), the printing medium P with the test patterns printed thereon is set in an outside scanner apparatus to carry out the reading.

Figure 30:
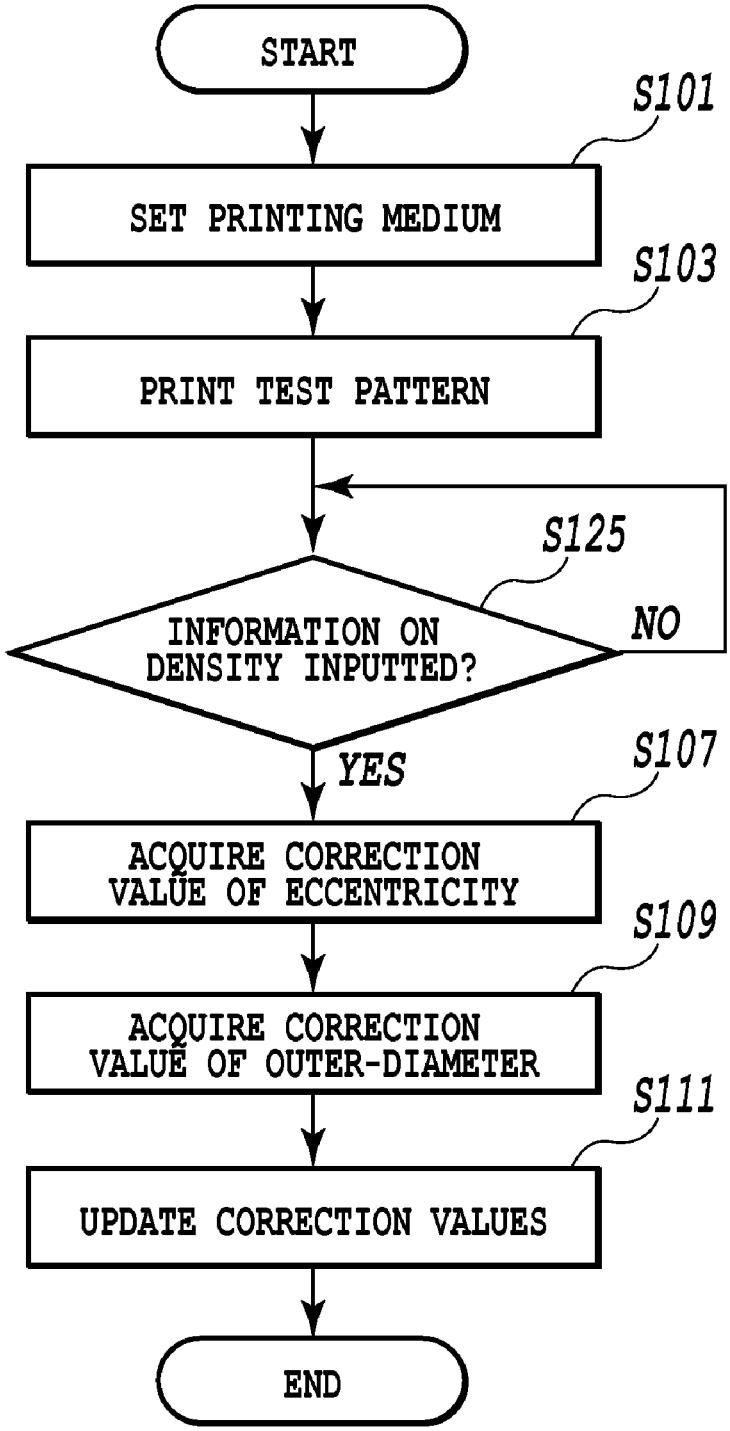
FIG. 30 is a flowchart showing another embodiment of the processing procedure from the formation of a test pattern to the storing of a conveying-error correction value.

FIG. 30 shows another example of the processing procedure corresponding to the configurations described above. The difference that this procedure has from the one described above is the provision of a process (step S125) in which the printing medium P with the test patterns formed thereon is set in an outside scanner apparatus followed by the inputting of the information on density thus read.

In addition, the arithmetic operation for the correction values may be executed not as a process done on the printing-apparatus side but as a process done by a printer driver operating within the host apparatus 1000 provided in the form of a computer connected to the printing apparatus.

Figure 31:
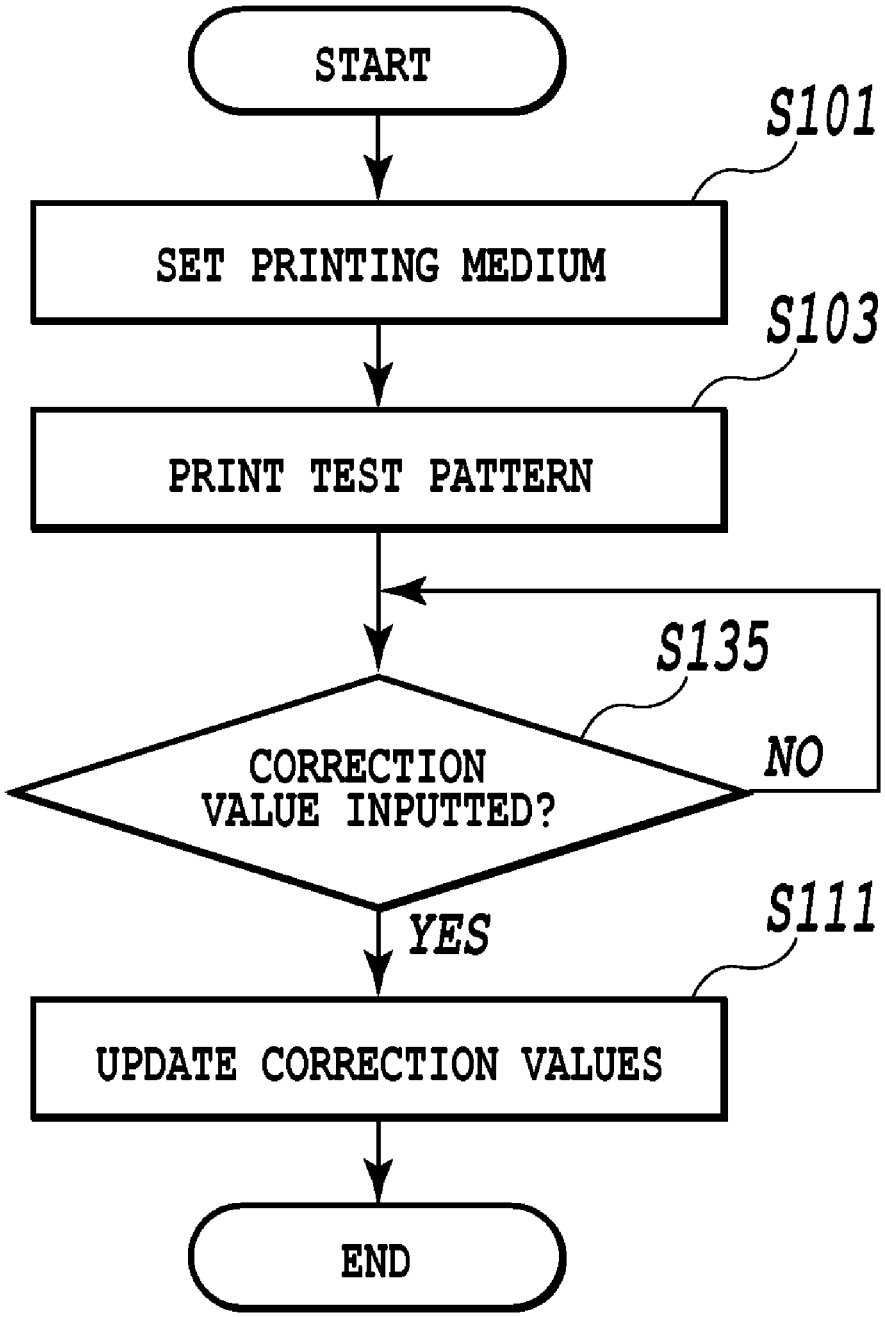
FIG. 31 is a flowchart showing still another embodiment of the processing procedure from the formation of a test pattern to the storing of a conveying-error correction value.

FIG. 31 shows an example of the processing procedure in this case. In this procedure, the printing medium P with the test patterns formed thereon is read using an outside scanner apparatus, and the information on density thus read is then supplied to the host apparatus 1000 to operate arithmetically the correction values. The printing apparatus awaits the imputing of the correction values (step S135). In a case where such an input is actually done, the correction values are stored (updated) in the EEPROM 103 (step S111).

The above-described processes may be executed either in response to the instruction given by the user. Alternatively, the user may delegate a serviceman to do the processes on behalf of the user, or the user may carry the apparatus in the service center to do the job. In any case, storing the correction values in the EEPROM 103 enables the correction values to be updated when it is necessary. As a result, the deterioration with age of the roller can be addressed properly.

However, assume a case where the deterioration with time is not a real problem, and where no update is necessary. In this case, a default value for the correction value may be determined in an inspection process done before the printing apparatus is shipped from the factory. Then, the default value thus determined is stored in the ROM 102, which is installed in the printing apparatus. In this sense, "the method of acquiring the correction value for the conveying-amount error" characterized: by an arithmetic operation for the correction value for eccentricity; and by a determination of the correction value for outer-diameter that follows the above-mentioned arithmetic operation, is not necessarily carried out within the printing apparatus, but can also be carried out using an apparatus, or an inspection system, that is provided independently of the printing apparatus.

(10) Other Modifications

The above-described embodiment and the modified examples thereof described in various places in the course of the descriptions are not the only ways of carrying out the present invention.

For example, in the configuration described above, the conveying roller 1 and the discharge roller 12 are respectively provided on the upstream side and on the downstream side in the direction of conveying the printing medium P. The printing medium P is conveyed by various conveying units since the printing medium P is loaded till the printing is finished. Assume that units other than the two rollers mentioned above are involved in the conveying, and that the conveying errors caused by the eccentricity or the variation in the outer diameter of each unit may possibly affect the printing quality. If this is the case, a conveying-error correction value can be acquired for each of the rollers in consideration independently or in combination with others. Also in this case, in a similar way to the one employed in the case described above, test patterns are printed firstly, and then an correction value for eccentricity and an correction value for outer-diameter are acquired on the basis of the information on density of the test patterns. In summary, the printing of the test patterns and the acquiring of the correction values can be carried out in accordance with the number of and the combination of the conveying units involved in the conveying at the time when the printing is actually done. In this way, an even and high-quality printing is possible on all over the printing medium P.

For example, in a case where only a single roller is used to convey the printing medium P, the conveying is always carried out by the single roller alone. As a result, there are only one kind of the printing of the test patterns and one kind of the conveying-error correction value. When two rollers are used in the conveying, the processes to be done can be divided, as in the above-described case, into a case where the conveying roller 1 is involved in the conveying and a case where the discharge roller 12 alone is involved in the conveying. In addition, the processes to be done can also be carried out by further dividing the former of the two resultant cases above into a case where the conveying roller 1 alone is involved in the conveying and a case where the conveying roller 1 is involved in the conveying in cooperation with the discharge roller 12. In a case of three rollers, the processes to be done can be divided into five, at the maximum, cases (areas) in a similar manner. In general terms, when the conveying is carried out by n rollers ($n \geqq 2$), the processes to be done can be divided into $3+1/2[n(n-1)]$ areas at the maximum.

In addition, in the example described above, the correction value for eccentricity and the correction value for outer-diameter are acquired for the discharge roller 12 as well. Suppose, however, a case where the discharge roller 12 is made of rubber. Rubber is a material, which is susceptible to the changes in environment and to the deterioration with age, and where reflecting the correction value for eccentricity for the discharge roller 12 may have few, if any, effects. If this is the case, the arithmetic operation for or the application of the correction value for eccentricity for the discharge roller 12 can be omitted.

Figure 32:
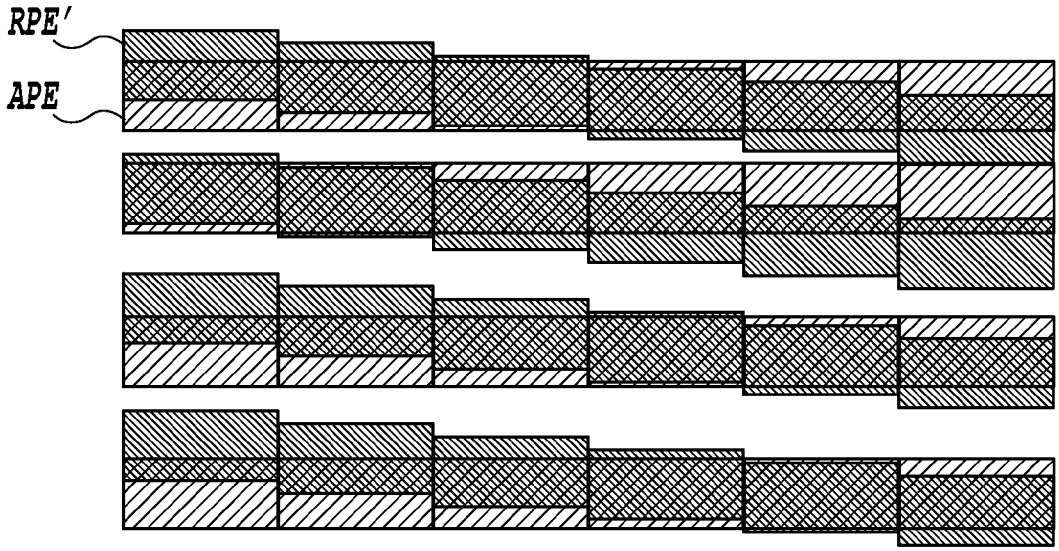
FIG. 32 is an explanatory diagram for describing an alternative way of forming patches constituting the test pattern.

Moreover, in the example described above, the patch elements for adjustment (the second patch elements) are printed using a part of the nozzle arrays that is located on the upstream side in the conveying direction. Alternatively, for example, as shown in FIG. 32, a printing medium P with patch elements for adjustment RPEs' printed thereon in advance may be used. Then, patch elements for reference APEs are printed using, fixedly, a particular nozzle group of all the nozzle arrays, and thus the formation of the test patterns is completed. After that, on the basis of the test pattern thus formed, processes to acquire the correction values are carried out. Note that the patch elements printed in advance may be the patch elements for reference RPEs', and that the patch elements for adjustment APEs may be printed in the later process.

Furthermore, given in the descriptions provided above are only examples of: the number of color-tones (color, density and the like) of the inks; the kind of the inks; the number of nozzles; ways of setting the range of nozzles actually used and ways of setting the amount of conveying the printing medium P. Likewise, various numerical values given in the descriptions above are also just examples of those that can be used.

In the foregoing descriptions, when plural test patterns are printed in the main-scanning direction (specifically, two test patterns, which are one on the conveying-reference side and another on the non-conveying-reference side, are printed in the descriptions given above), a correction value is selected by comparing the plural test patterns with each other. Here, the selected correction value can reduce best the influence of one of the conveying errors that has the most prominent influence. Specifically, the correction function is determined by selecting one of the entire combinations of the amplitude and the initial phase that produces the minimum value of the larger one of the sums of the squared values $\Sigma|X_n''|^2$ for the conveying-reference side and for the non-conveying-reference side.

However, the above-mentioned method is not the only formula for selecting a combination of the amplitude and the initial phase on the basis of the plural test patterns printed in the main-scanning direction.

A specific example of the selection is carried out as follows. Firstly, the amplitude and the initial value that are optimum for the correction value to correct the eccentricity of the roller are determined for each of the conveying-reference side and the non-conveying-reference side. Then, the initial phase is determined by calculating the average value of the initial phases determined for the respective sides. For example, suppose that the optimum initial phase for the conveying-reference side is determined to be $-5\times2\pi/110$ and that for the non-conveying-reference side is determined to be $-25\times2\pi/110$. Then, from these values, the optimum initial phase for correcting the eccentricity of the entire roller is determined to be $-15\times2\pi/110$. Likewise, the optimum amplitude may be determined by calculating the average value. Here, there may be cases where only a small number of adoptable values of the amplitude exist as in the case of this embodiment, which has only three values of the kind. Then, the amplitude for the conveying-reference side can be adopted simply as it is because the printing medium is more frequently conveyed by the portion of the roller on the conveying-reference side. Alternatively, the initial phase or the amplitude of each of the conveying-reference side and the non-conveying-reference side may be weighted. Then, the average value of the weighted values may be adopted to perform the correction. This method is effective to obtain a high-quality image with less unevenness for a printing apparatus in which a roller with eccentricity and deflection is used. In this case, a weighting factor can be determined by considering an influence of each of the eccentricity and the deflection on an image.

Another specific example of the selection is carried out as follows. Firstly, the sums of the squared values $\Sigma|X_n''|^2$ for the conveying-reference side and for the non-conveying-reference side are added together for all the combinations of the amplitude and the initial phase. Then, a determination is made to select one of the combinations of the amplitude and the initial phase that has the minimum added value of the sums of the squared values for the conveying-reference side and for the non-conveying-reference side.

Furthermore, application of the present invention to the so-called serial-type inkjet printing apparatus has been described in the example given above. The present invention, however, can be applicable to a so-called line-printer type ink-jet printing apparatus equipped with a line-type head in which nozzles are arranged across the range corresponding to the width of the printing medium. In this case, a preferable configuration may have one line-type head disposed on the upstream side in the conveying direction and another on the downstream side. Then, while the reference patch element such as one described above is printed by use of one of these heads, the patch element for adjustment is printed by use of the other one of the heads with the timing for printing being shifted. From the test patterns thus obtained, the conveying error of the roller can be obtained and the correction value for the roller can also obtained.

2. Characteristic Configuration

Assume that each roller is manufactured within a predetermined design tolerance. Even in this case, the conveying error that derives from such factors as the amount of eccentricity, the state of eccentricity, and the outer-diameter dimension of the roller may sometimes differ between a position on the conveying-reference side and a position on the non-conveying-reference side (hereafter, also referred to as "there is a right-and-left difference"). Among various types of rollers, such a difference is more prominent in rollers used in a large-scale inkjet printing apparatus that can print even on an A3 or larger printing medium. The present invention addresses this problem by plural test patterns printed in the main-scanning direction. In the above-described example, a correction function with optimum amplitude and optimum initial phase obtained by the plural test patterns is determined, and the correction value for eccentricity is acquired on the basis of the correction function thus determined.

Accordingly, in a printing apparatus using a roller that has differences in its amount of and its state of eccentricity along the longitudinal direction of the roller, that is, at a point on the conveying-reference side and at a point on the non-conveying-difference side, the degradation of the image quality caused by the eccentricity can be prevented even in a case where printing is performed on a relatively large size printing medium. Here, there are printing media of various sizes that are used in a printing apparatus, and the printing medium used in the printing apparatus of the above example is conveyed with one of its side portions moving along the conveying reference member 14 irrespective of the dimension of the printing medium in its width direction. To put it other way, a printing medium with a relatively large size in its width direction has a broader contact area with the conveying roller 1 while a printing medium with a relatively small size in its width direction has a narrower contact area with the conveying roller 1. Accordingly, the setting of a correction value for correcting the conveying error for the entire area in the longitudinal direction of the conveying roller 1 (such an area is simply referred to as the first zone, and the correction value for the first zone is simply referred to as the first-zone correction value) is valid for the former case, that is, for a relatively wide printing medium, but the value thus set is not always the optimum value for the latter case, that is, for a relatively narrow printing medium.

Accordingly, employed as the characteristic configuration is one with which high-quality printing can be performed on a printing medium of any size by applying the optimum correction value suitable for the size of the printing medium (specifically, the size in the width direction).

(1) First Example of Characteristic Configuration

Figure 33:
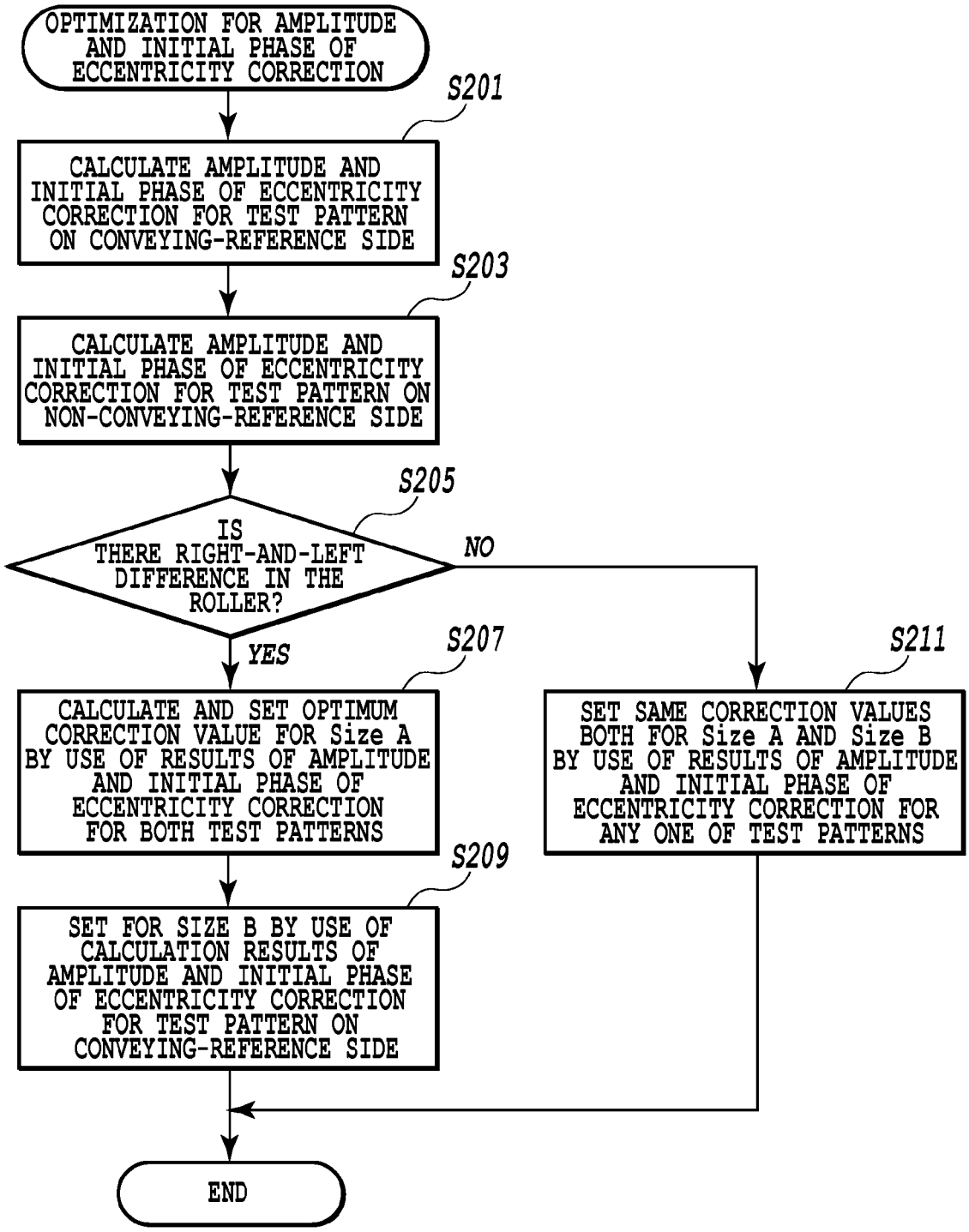
FIG. 33 is a flowchart showing a first example of the characteristic configuration of the present invention.

FIG. 33 shows a procedure for arithmetically processing the correction value for eccentricity according to a first example of the characteristic configuration. The procedure shown in FIG. 33 is a detailed procedure that follows a positive determination at step S25 in FIG. 18. Following the procedure shown in FIG. 33, optimum correction values for eccentricity for a printing medium of a relatively large size and for a printing medium of a relatively small size are determined and the optimum correction values for eccentricity thus determined are allowed to be applied. The printing medium of a relatively large size mentioned here is a printing medium with a width that is larger than the width of a letter-size printing medium, which has a 216-mm width (for example, a printing medium of A3, A3 plus, Half-size, or the like; hereafter referred to as a printing medium of Size A). This kind of printing medium has a relatively broad contact area with the roller. On the other hand, the printing medium of a relatively small size mentioned here is a printing medium with an equivalent or smaller size than the letter size (for example, a printing medium of A4, A5, Postcard, L-size, or the like; hereafter referred to as a printing medium of Size B). This kind of printing medium has a relatively narrow contact area with the roller. To put it other way, the contact area for this kind of printing medium is only a part of the entire area that is closer to the conveying reference member 14.

Firstly, at step S201, an optimum combination of the amplitude and the initial phase is determined on the basis of the test pattern located on the conveying-reference side (for example, the test pattern FR1 in FIG. 5), following the procedure described with reference to FIGS. 19 to 21. Then, at step S203, an optimum combination of the amplitude and the initial phase is determined on the basis of the test pattern located on the non-conveying-reference side (for example, the test pattern FR2 in FIG. 5), following the procedure described with reference to FIGS. 19 to 21.

Then, at step S205, a determination is made whether the combinations of the amplitude and the initial phase thus obtained from the two test patterns are different. To put it other way, whether the roller has a right-and-left difference is determined. This process corresponds to the above-described step S23 in FIG. 18.

With a positive determination made here, the operational flow proceeds to step S207. Following the procedure described with reference to FIG. 33, a correction value for eccentricity is determined by obtaining a correction function used to correct the conveying error for the entirety of the conveying roller 1 in the longitudinal direction. The correction value for eccentricity thus determined is then set into the EEPROM 103. Subsequently, at step S209, another correction value for eccentricity is determined by obtaining a correction function used to correct the conveying error at a position that is close to the conveying reference member 14 (such a position is referred to a second zone, and the correction value for the second zone is referred to as a second-zone correction value). The correction value for eccentricity thus determined is also set into the EEPROM 103. To store these two kinds of correction values for eccentricity, two different kinds of tables corresponding respectively to different sizes of the printing medium may be provided in the EEPROM 103.

On the other hand, with a negative determination made at step S205, that is, when the roller has no right-and-left difference, the operational flow proceeds to step S211. Then the correction value for eccentricity is determined on the basis of any one of the correction functions, for example, of the correction function used to correct the conveying error at a position that is close to the conveying reference member 14. The correction value for eccentricity thus determined is then set into the EEPROM 103.

Note that, in this example, two test patterns are printed in the main-scanning direction, and the printing media are classified into two categories based on the size—relatively large and relatively small. In addition, two different optimum correction values for eccentricity are allowed to be set respectively for the two categories of printing media. However, it is also possible to print three or more test patterns in the main-scanning direction and to allow three or more different optimum eccentricity values that are settable so as to correspond respectively to three or more different sizes of printing media. Moreover, use of a printing medium of a size that allows the printing of plural test patterns in the main scanning direction reduces the time and the botheration that are needed to obtain two or more different correction values for eccentricity. Nevertheless, it also is possible to print test patterns for each of the printing media of different sizes and then to acquire the correction values for eccentricity. These variations are also allowed in the following second and third examples to be described below.

(2) Second Example of Characteristic Configuration

The descriptions given in the first example are based on a case where the correction value for eccentricity is settable so as to correspond to the size of the printing medium actually used. Now remember that the essence of the present invention is to make it possible to set the conveying error correction value that corresponds to the size of the printing medium, the printing medium is actually used when a roller has a difference of the conveying error between a position on the conveying-reference side and a position on the non-conveying reference side. To put it other way, the present invention is applicable to a case where the outer diameter of the roller varies along its longitudinal direction irrespective of whether an eccentricity correction is or is not performed, or irrespective of whether an eccentricity correction is or is not necessary. Accordingly, the descriptions given in this second example of the characteristic configuration are based on a case where the correction value for outer-diameter is made to be settable so as to correspond to the size of the printing medium actually used.

Figure 34:
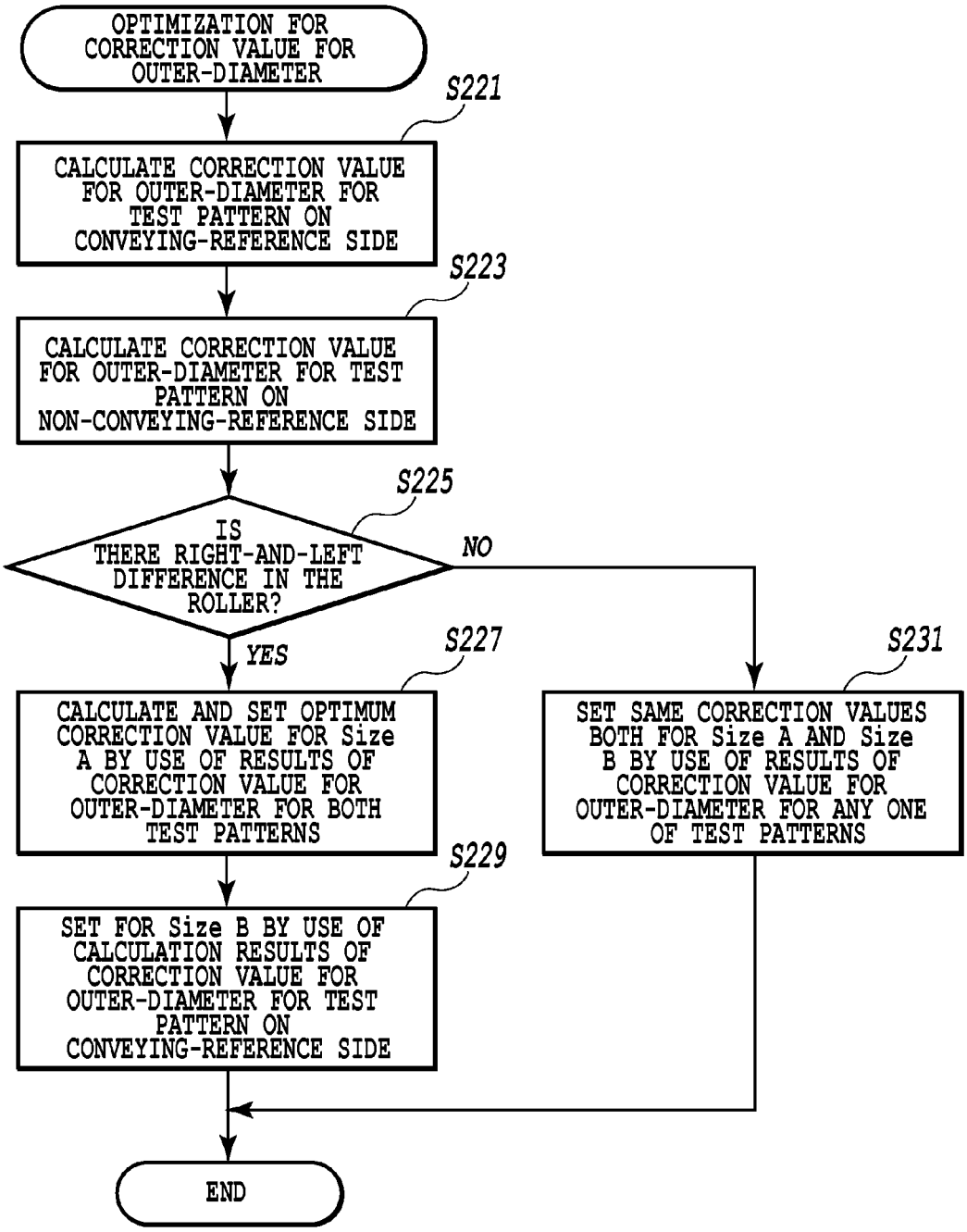
FIG. 34 is a flowchart showing a second example of the characteristic configuration of the present invention.

FIG. 34 shows a procedure for arithmetically processing the correction value for eccentricity according to a second example of the characteristic configuration. The procedure shown in FIG. 34 is a detailed procedure that follows a positive determination at step S45 in FIG. 23. Following the procedure shown in FIG. 34, optimum correction values for outer-diameter for a printing medium of a relatively large size (a printing medium of Size A) and for a printing medium of a relatively small size (a printing medium of Size B) are determined and the optimum correction values for outer-diameter thus determined are allowed to be applied.

Firstly, at step S221, a correction value for outer-diameter is determined on the basis of the test pattern located on the conveying-reference side (for example, the test pattern FR1 in FIG. 5), in a similar way to that described with reference to steps S49 and S51 of FIG. 23. Then, at step S223, a correction value for outer-diameter is determined on the basis of the test pattern located on the non-conveying-reference side (for example, the test pattern FR2 in FIG. 5).

Then, at step S225, a determination is made whether the correction values for outer-diameter thus obtained from the two test patterns are different. To put it other way, whether the roller has a right-and-left difference with respect to the outer diameter is determined. With a positive determination made here, the operational flow proceeds to step S227. The correction value for outer-diameter used to correct the conveying error all along the entirety in the longitudinal direction of the conveying roller 1 (first-zone correction value) is set into the EEPROM 103. In addition, at step S229, the correction value for outer-diameter for a position that is close to the conveying reference member 14 (second-zone correction value) is set into the EEPROM 103. Into the EEPROM 103, these two different correction values for outer-diameter are allowed to be stored so as to correspond respectively to the two different sizes of the printing medium.

On the other hand, with a negative determination made at step S225, that is, the roller has no right-and-left difference, the operational flow proceeds to step S231. Then the correction value for outer-diameter for any one of the correction functions, for example, the correction value for outer-diameter for a position that is close to the conveying reference member 14 is set into the EEPROM 103.

(3) Third Example of Characteristic Configuration

The descriptions given in the first example are based on a case where the correction value for eccentricity is settable so as to correspond to the size of the printing medium actually used. The descriptions given in the second example are based on a case where the correction value for outer-diameter is settable so as to correspond to the size of the printing medium actually used. It is certain that performing only one of the above-mentioned two corrections can bring about an effect of reducing the harmful effects on images caused by the conveying error. Performing the two correction combined, however, makes it possible to print an image with higher quality. In addition, the printing of still higher quality image can be expected by acquiring the correction value for outer-diameter by use of the correction value for eccentricity as described above.

The processes carried out in the third example of the present invention are the processes following the process flow shown in FIG. 4 for the basic configuration. In the case of the third example, in the procedure shown in FIG. 23, which corresponds to the details of step S17 shown in FIG. 4, with a positive determination made at step S45, the procedure shown in FIG. 33 is carried out. In the meanwhile, in the procedure shown in FIG. 23, which corresponds to the details of step S17, with a negative determination made at step S45, the procedure shown in FIG. 34 is carried out.

(4) Application of Correction Value

Figure 35:
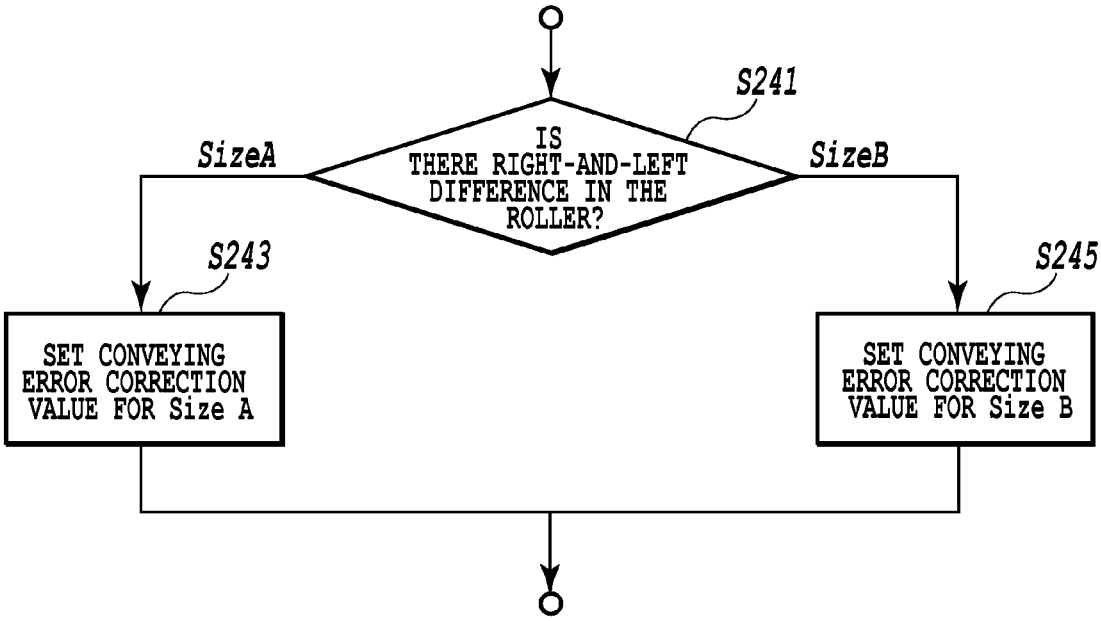
FIG. 35 is a flowchart showing an example of the processing procedure for applying, in accordance with the size of the printing medium, the conveying error correction value obtained by the procedure described in FIG. 33 and/or FIG. 34.
Figure 36:
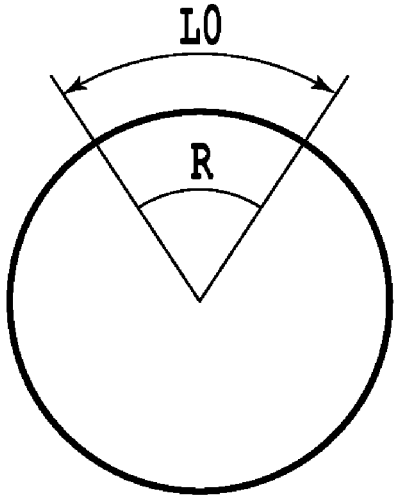
FIG. 36 is an explanatory diagram of a state of a conveying roller that has a perfectly-circular cross-sectional shape, and has its central axis aligned exactly with its rotational axis.
Figure 37A:
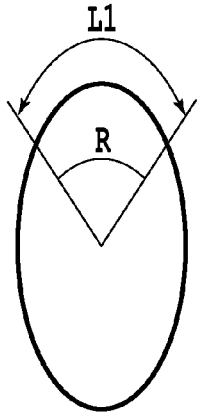
FIGS. 37A and 37B are explanatory diagrams of a state of conveying roller which has a cross-sectional shape that is not a perfect circle.
Figure 37B:
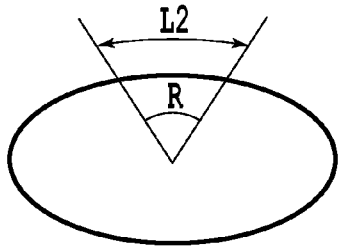
Figure 38:
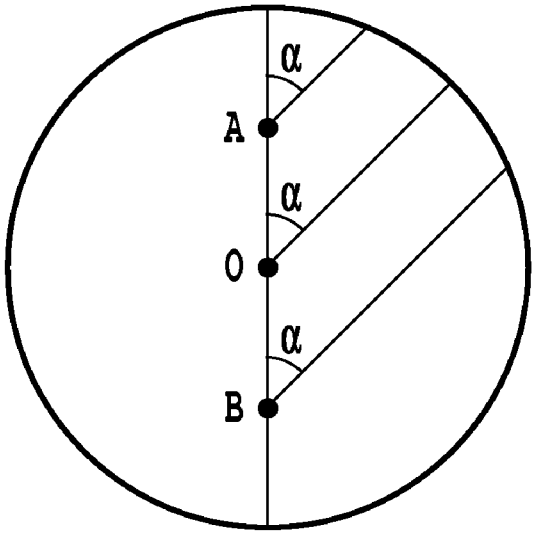
FIG. 38 is an explanatory diagram of a state of a conveying roller that has its rotational axis offset from its central axis.
Figure 39A:
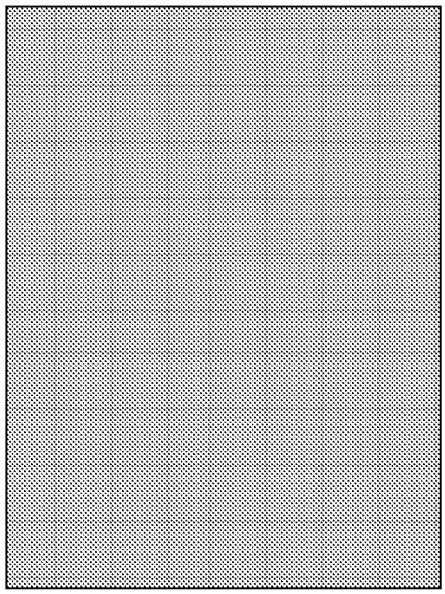
FIGS. 39A and 39B are explanatory diagrams of images with and without unevenness caused by the eccentricity of the conveying roller, respectively.
Figure 39B:
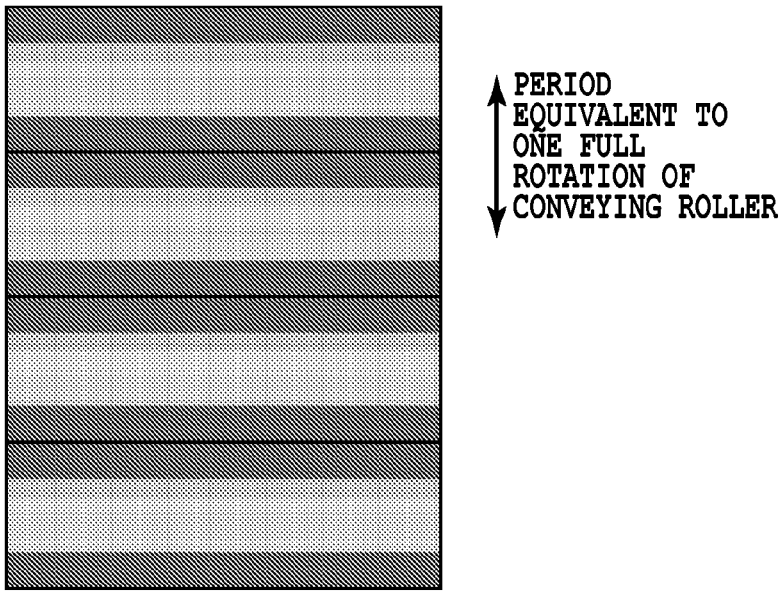

FIG. 35 shows an example of the processing procedure for applying, in accordance with the size of the printing medium, the conveying error correction value (correction value for eccentricity and/or correction value for outer-diameter) thus set. The procedure shown in FIG. 35 can be regarded as a step that is followed by the procedure for conveyance control described with reference to FIG. 27.

This procedure begins with the identification of the size of the printing medium actually used for the printing at step S241. With a determination that a printing medium of Size A is used, the operational flow proceeds to step S243, where the setting is conducted so that the conveying error correction value can be referred to, the value being stored in the EEPROM 103 for the correction of the conveying error for the entirety of the conveying roller 1 in the longitudinal direction. On the other hand, with a determination that a printing medium of Size B is used, the operational flow proceeds to step S245, where the setting is conducted so that the conveying error correction value can be referred to, the value being stored in the EEPROM 103 for the correction of conveying error at a position that is close to the conveying reference member 14. Thereafter, the process of step S61 in FIG. 27 and the processes that follow are carried out.

(5) Others

It should be noted that in the above-described characteristic configuration, the size of the printing medium used for the printing can be identified on the basis of the information notified in response to the selection of the size of the printing medium conducted by use of the setting screen of the printer driver which works in the host apparatus 1000 (FIG. 2). Alternatively, the identification may be carried out by use of the read sensor 120 and the like.

In each of the above-described examples of the characteristic configuration, the second-zone correction value is acquired by use of a part of the plural test patterns used to acquire the first-zone correction value. Alternatively, the second-zone correction value may be acquired by forming, separately, a test pattern that is especially dedicated for the purpose.

In addition, not only the size of the printing medium but also the area or zone of the roller involved in the conveying of the printing medium can be employed as conditions of the printing medium. The formation of the test patterns or the acquisition of the first-zone and the second-zone corrections can be carried out on the basis of the conditions thus set up. In the examples above, the end portion where the member 14 is disposed is fixedly used as the conveying reference, but the conveying reference may sometimes be set as the other end portion on the opposite side in response to the supplying route of the printing medium. In such a case, different areas or zones of the roller may be involved in the conveying of the printing media of the same size when the conveying reference is different. Consequently, different correction values have to be applied. Taking account of the change of the conveying reference described above, it is preferable that both the correction value on the basis of the test patterns located on the left-hand side in FIG. 5 (FR1, ER1) and the correction value on the basis of the test patterns located on the right-hand side in FIG. 5 (FR2, ER2) be acquired for a printing medium of a relatively small size, for example. To put it other way, concerning the first-zone and the second-zone involved in the conveying of the printing medium, the state in which the second zone entirely included in the first zone is not the only possible relationship between the two zones.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2007-119915, filed Apr. 27, 2007, which is hereby incorporated by reference herein in its entirety.

What is claimed is:

1. A printing apparatus comprising:

a printing head;

a roller configured to convey a print medium in a conveyance direction, where a longitudinal direction of the roller crosses the conveyance direction, and the roller is provided over a usable width of the print medium;

a forming unit configured to form a first test pattern and a second test pattern side by side, where the first test pattern is configured to detect a conveying error of the roller corresponding to a first zone relatively away from a predetermined position of the roller in the longitudinal direction, and the second test pattern is configured to detect a conveying error of the roller corresponding to a second zone relatively close to the predetermined position of the roller in the longitudinal direction;

an acquisition unit configured to:

(i) acquire a first correction value for correcting a conveying error corresponding to a conveyance by the first zone and second zone of the roller, by using the first and second test patterns, and (ii) acquire a second correction value for correcting the conveying error corresponding to a conveyance by the second zone of the roller by using the second test pattern; and a conveying control unit configured to control the conveyance of the print medium with the roller by applying the first correction value when a width of the print medium to be conveyed, in the longitudinal direction, is larger than a predetermined width, and by applying the second correction value when the width of the print medium is smaller than the predetermined width.

2. A printing apparatus as claimed in claim 1, wherein each of the first and second correction values includes a group of eccentricity correction values that are associated with rotational angles from a reference position of the roller, the group of eccentricity correction values being used to correct a conveying error that depends on an eccentricity of the roller, and wherein the acquisition unit compares the first test pattern and the second test pattern, and acquires the first correction value using a test pattern that most reflects an influence of the conveying error that depends on the eccentricity.

3. A printing apparatus as claimed in claim 1, wherein each of the first and second correction values includes an outer diameter correction value used to correct a conveying error that depends on an outer diameter of the roller.

4. A printing apparatus as claimed in claim 1, wherein each of the first and second correction values includes:

a group of eccentricity correction values that are associated with rotational angles from a reference position of the roller, the group of eccentricity correction values being used to correct a conveying error that depends on an eccentricity of the roller; and an outer diameter correction value used to correct a conveying error that depends on an outer diameter of the roller, and wherein the acquisition unit compares the first test pattern and the second test pattern, and acquires the first correction value using a test pattern that most reflects an influence of the conveying error that depends on the eccentricity.

5. A printing apparatus as claimed in claim 1, further comprising a unit for identifying the size of the printing medium.

6. A printing apparatus as claimed in claim 1, wherein an image is printed on the printing medium by:

scanning the printing head in the longitudinal direction; and conveying the printing medium by the roller.

7. A printing apparatus as claimed in claim 1, further comprising a unit for reading the first test pattern and the second test pattern, in order to acquire the first and second correction values.

8. A printing apparatus as claimed in claim 1, wherein the predetermined position is a conveying reference provided at one end of the roller in the longitudinal direction in a conveying path of the print medium.

9. A method of controlling a printing apparatus that includes a printing head and a roller for conveying a print medium along a conveyance direction, where the longitudinal direction of the roller crosses the conveyance direction, and where the roller is provided over a usable width of the print medium, the method comprising:

a forming step of forming a first test pattern and a second test pattern side by side, where the first test pattern is configured to detect a conveying error of the roller corresponding to a first zone relatively away from a predetermined position of the roller in the longitudinal direction, and the second test pattern is configured to detect a conveying error of the roller corresponding to a second zone relatively close to the predetermined position of the roller in the longitudinal direction;

an acquisition step of acquiring:

(i) a first correction value for correcting a conveying error corresponding to a conveyance by the first zone and the second zone of the roller, by using the first and second test patterns, and (ii) a second correction value for correcting the conveying error corresponding to a conveyance by the second zone of the roller, by using the second test pattern; and a conveyance control step of controlling the conveyance of the print medium with the roller by applying the first correction value when a width of the print medium to be conveyed, in the longitudinal direction, is larger than a predetermined width, and by applying the second correction value when the width of the print medium is smaller than the predetermined width.

* * * * *